US007929884B2

(12) United States Patent
Yoshizuka et al.

(10) Patent No.: US 7,929,884 B2
(45) Date of Patent: Apr. 19, 2011

(54) IMAGE FORMING APPARATUS, DEVELOPING UNIT, AND COMPUTER SYSTEM

(75) Inventors: Ken Yoshizuka, Nagano-ken (JP); Toshiya Takahata, Nagano-ken (JP); Yoichiro Irie, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/574,362

(22) Filed: Oct. 6, 2009

(65) Prior Publication Data

US 2010/0021191 A1 Jan. 28, 2010

Related U.S. Application Data

(62) Division of application No. 10/491,647, filed as application No. PCT/JP03/04701 on Apr. 14, 2003, now Pat. No. 7,646,994.

(30) Foreign Application Priority Data

Apr. 16, 2002 (JP) ..... 2002-113946
May 21, 2002 (JP) ..... 2002-146891

(51) Int. Cl.
*G03G 15/01* (2006.01)

(52) U.S. Cl. ..... 399/227; 399/12

(58) Field of Classification Search ..... 399/12, 399/27, 116, 119, 227
See application file for complete search history.

(56) References Cited

U.S. PATENT DOCUMENTS 5,926,665 A 7/1999 Suzuki
6,173,129 B1 1/2001 Kimizuka
7,340,201 B2 3/2008 Yoshizuka et al.
2002/0021909 A1 2/2002 Harumoto
2002/0051649 A1 5/2002 Ohjimi et al.

FOREIGN PATENT DOCUMENTS

JP 9-190139 A 7/1997
JP 10-221938 8/1998
JP 2001-22230 A 1/2001
JP 2001-117309 A 4/2001
JP 2001-166649 A 6/2001
JP 2001-222192 A 8/2001
JP 2002-14579 1/2002
JP 2002-49206 A 2/2002
JP 2002-62784 A 2/2002
JP 2002-74295 A 3/2002

OTHER PUBLICATIONS

Supplementary European Search Report corresponding to European Patent Application No. 03746479 dated Jun. 7, 2010.

*Primary Examiner* — David M Gray
*Assistant Examiner* — Andrew V Do
(74) *Attorney, Agent, or Firm* — Sughrue Mion, PLLC

(57) ABSTRACT

An image forming apparatus, for example, that is capable of accurately writing information into a developing unit or the like having an element is achieved. An image forming apparatus comprises: an attach/detach section to and from which a developing unit having an element into which information can be written and a developer containing section can be attached and detached; a photoconductor on which a latent image can be formed; a writing member for writing information into the element; and an AC voltage supply section for supplying an AC voltage. During a period from a start to an end of an image forming process, the writing member writes information into the element of the developing unit attached to the attach/detach section when the AC voltage supply section is not supplying an AC voltage.

9 Claims, 16 Drawing Sheets

| address | information content (8 bit) |
|---|---|
| 00H | ID information |
| 01H | manufacturing date |
| 02H | destination |
| 03H | manufacturing line |
| 04H | compatible models |
| 05H | toner remaining amount |
| ⋮ | ⋮ |

FIG. 7

| address | information content (8 bit) |
|---|---|
| 00H | ID information |
| 01H | manufacturing date |
| 02H | destination |
| 03H | manufacturing line |
| 04H | compatible models |
| 05H | number of sheets printed by printer unit when usage starts |
| 06H | number of sheets printed by printer unit when usage ends |
| 07H | number of sheets printed in color |
| 08H | number of sheets printed in monochrome |
| ⋮ | ⋮ |

FIG. 8

IMAGE FORMING APPARATUS, DEVELOPING UNIT, AND COMPUTER SYSTEM

CROSS-REFERENCES TO RELATED APPLICATIONS

This application is a divisional of U.S. application Ser. No. 10/491,647 filed Jan. 5, 2005, now U.S. Pat. No. 7,646,994 which is a national stage application of a PCT/JP03/04701, filed Apr. 14, 2003, which claims priority from JP 2002-113946 filed Apr. 16, 2002 and JP 2002-146891, filed May 21, 2002. The entire disclosures of all of these applications are incorporated herein by reference in their entirety.

TECHNICAL FIELD

The present invention relates to image forming apparatuses, developing units that can be attached to and detached from an image forming apparatus unit, and computer systems provided with a computer unit and an image forming apparatus.

BACKGROUND ART

Among image forming apparatuses such as laser beam printers, there are those in which a developing unit provided with a memory can be attached to and detached from the image forming apparatus unit. In such image forming apparatuses, information is written into and read from an element provided on the developing unit.

There are also image forming apparatuses that have AC voltage supply sections. In such image forming apparatuses, an AC voltage is supplied from the AC voltage supply section to, for example, the developing device or the charging device, and this AC voltage is used for developing latent images or charging the photoconductor.

However, it is necessary that information is accurately written into and read from the memory. For example, when writing information about the remaining amount of toner into the memory provided on the developing unit, if incorrect information is written, then the amount of toner remaining in the developing unit cannot be managed properly.

The present invention has been made in view of the foregoing problem, and it is an object thereof to achieve image forming apparatuses and computer systems with which information can be accurately written into developing units having elements, for example.

It is a further object of the present invention to achieve developing units, image forming apparatuses, and computer systems with which communication with an element can be carried out accurately.

DISCLOSURE OF INVENTION

A main aspect of the present invention is an image forming apparatus comprising: an attach/detach section to and from which a developing unit having an element into which information can be written and a developer containing section can be attached and detached; a photoconductor on which a latent image can be formed; a writing member for writing information into the element; and an AC voltage supply section for supplying an AC voltage, wherein, during a period from a start to an end of an image forming process, the writing member writes information into the element of the developing unit attached to the attach/detach section when the AC voltage supply section is not supplying an AC voltage.

Further, another main aspect of the present invention is an image forming apparatus comprising: a photoconductor unit attach/detach section to and from which a photoconductor unit having an element into which information can be written and a photoconductor can be attached and detached; a developing device for developing a latent image formed on the photoconductor; a writing member for writing information into the element; and an AC voltage supply section for supplying an AC voltage, wherein, during a period from a start to an end of an image forming process, the writing member writes information into the element of the photoconductor unit attached to the photoconductor unit attach/detach section when the AC voltage supply section is not supplying an AC voltage.

Further, another main aspect of the present invention is a developing unit comprising: a developer bearing body including a rotating shaft and a large diameter section that has a diameter larger than a diameter of the rotating shaft and that is for bearing developer, wherein the developer bearing body is capable of rotating about the rotating shaft; an element with which communication is possible; and a developer containing section for containing developer, wherein the element is provided more to the outside than the large diameter section in an axial direction of the rotating shaft.

Further, another main aspect of the present invention is an image forming apparatus comprising: a developing unit including a developer bearing body including a rotating shaft and a large diameter section that has a diameter larger than a diameter of the rotating shaft and that is for bearing developer, wherein the developer bearing body is capable of rotating about the rotating shaft, an element with which communication is possible, and a developer containing section for containing developer; an attach/detach section to and from which the developing unit can be attached and detached; and an antenna for wirelessly communicating with the element of the developing unit attached to the attach/detach section, wherein the element is provided more to the outside than the large diameter section in an axial direction of the rotating shaft.

Features and objects of the present invention other than the above will become clear through the discussion of the present description and the accompanying drawings.

BRIEF DESCRIPTION OF DRAWINGS

FIG. 7 is a diagram for describing information stored in a memory cell 54*h* of the element 54*a*.

FIG. 8 is a diagram for describing information stored in a memory cell of the element 54*a* of the photoconductor unit 75.

Figure 1:
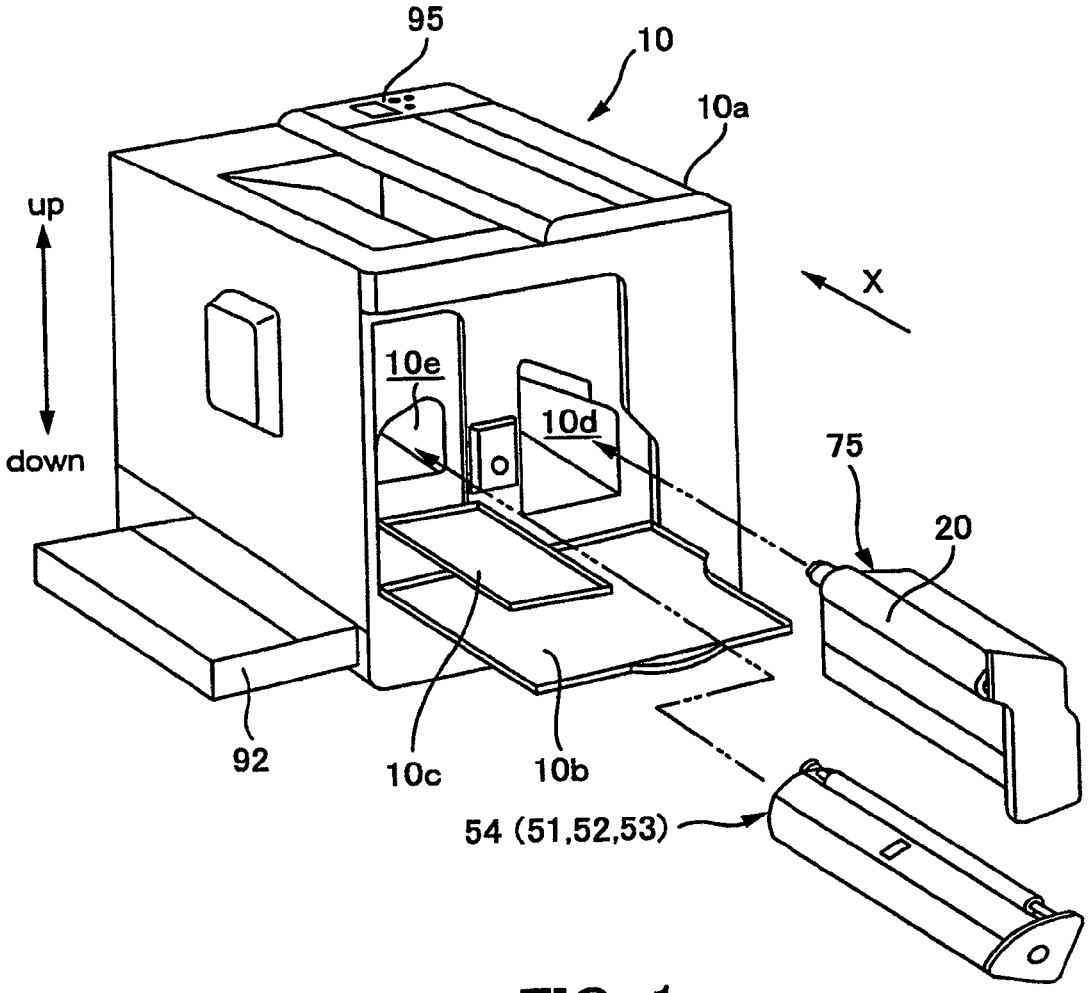
FIG. 1 is a diagram for describing a configuration in which a developing unit 54 (51, 52, 53) and a photoconductor unit 75 are attached to and detached from a printer unit 10*a*.

A legend of the main reference characters used in the drawings is described below.

10 printer
10*a* printer unit
10*b* first open/close cover
10*c* second open/close cover
10*d* photoconductor unit attach/detach opening
10*e* developing unit attach/detach opening
20 photoconductor
30 charging unit
40 exposing unit
50 YMCK developing device
51 cyan developing unit
52 magenta developing unit
53 black developing unit
54 yellow developing unit
51*a*, 52*a*, 53*a*, 54*a* elements
54*b* noncontact IC chip
54*c* resonant capacitor
54*d* antenna
54*e* rectifier
54*f* signal analysis section RF
54*g* controller
54*h* memory cell
55 rotary
55*a* central shaft
55*b*, 55*c*, 55*d*, 55*e* attach/detach sections
60 first transferring unit
70 intermediate transferring body
75 photoconductor unit
75*a* element
76 cleaning blade
76*a* waste toner containing section
80 second transferring unit
90 fusing unit
92 paper supply tray
94 paper supply roller
95 display unit
96 resist roller
100 control unit
101 main controller
102 unit controller
112 interface
113 image memory
120 CPU
121 serial interface
122 printer-side memory (storage element)
123 send/receive circuit
124*a* printer-side antenna (for communicating with photoconductor unit element)
124*b* printer-side antenna (for communicating with developing unit elements)
125 YMCK developing device drive control circuit
126*a* AC voltage supply section
126*b* DC voltage supply section
127 exposing unit drive control circuit
127*a* pixel counter
510 developing roller (developer bearing roller)
520 seal member
524 seal urging member
522 seal support metal plate
530 first toner containing section
535 second toner containing section
540 housing
541 opening
545 restriction wall
550 toner supply roller (toner supplying member)
560 restriction blade
560*a* rubber section
560*b* rubber support section
562 blade support metal plate
570 blade backing member
1000 computer system
1102 computer unit
1104 display device
1106 printer
1108 input device
1108A keyboard
1108B mouse
1110 reading device
1110A flexible disk drive device
1110B CR-ROM drive device
1202 internal memory
1204 hard disk drive unit
T toner
RS read sensor for synchronization
2051 cyan developing unit
2052 magenta developing unit
2053 black developing unit
2054 yellow developing unit
2051*a*, 2052*a*, 2053*a*, 2054*a* elements
2124*b* printer-side antenna (for communicating with developing unit elements)
2510 developing roller (developer bearing roller)
2512 rotating shaft
2514 large diameter section
2520 seal member
2524 seal urging member
2522 seal support metal plate

2530 first toner containing section
2535 second toner containing section
2540 housing
2541 opening
2545 restriction wall
2550 toner supply roller (toner supplying member)
2560 restriction blade
2560*a* rubber section
2560*b* rubber support section
2562 blade support metal plate
2570 blade backing member

BEST MODE FOR CARRYING OUT THE INVENTION

At least the following matters will be made clear by the discussion in the present description and the accompanying drawings.

An image forming apparatus comprises: an attach/detach section to and from which a developing unit having an element into which information can be written and a developer containing section can be attached and detached; a photoconductor on which a latent image can be formed; a writing member for writing information into the element; and an AC voltage supply section for supplying an AC voltage, wherein, during a period from a start to an end of an image forming process, the writing member writes information into the element of the developing unit attached to the attach/detach section when the AC voltage supply section is not supplying an AC voltage.

If a developing unit, which has an element into which information can be written and a developer containing section, is configured so that it can be attached to and detached from an attach/detach section, then there is a possibility that a developing unit attached to the attach/detach section will become detached. Consequently, it is preferable that information about the remaining amount etc. of developer that is contained in the developing unit is suitably written into the element of that developing unit. On the other hand, if an AC voltage supply section for supplying an AC voltage is provided, then when the AC voltage supply section is supplying an AC voltage, there is a possibility that electromagnetic noise will be generated in the periphery of the AC voltage supply section.

With the foregoing image forming apparatus, the writing member writes information into the element of the developing unit attached to the attach/detach section when the AC voltage supply section is not supplying an AC voltage during the period from the start to the end of an image forming process, and thus information can be written accurately without being affected by noise caused by supplying the AC voltage, for example.

Further, in this image forming apparatus, the developing unit may have a developer bearing body for bearing developer; and the AC voltage supply section may supply an AC voltage to the developer bearing body.

With this image forming apparatus, the writing member writes information into the element of the developing unit attached to the attach/detach section when the AC voltage supply section is not supplying an AC voltage to the developer bearing body during the period from the start to the end of an image forming process, and thus information can be written accurately without being affected by noise caused by supplying the AC voltage to the developer bearing body, for example.

Further, in this image forming apparatus, the image forming apparatus may comprise a charging member for charging the photoconductor; and the AC voltage supply section may supply an AC voltage to the charging member.

With this image forming apparatus, the writing member writes information into the element of the developing unit attached to the attach/detach section when the AC voltage supply section is not supplying an AC voltage to the charging member during the period from the start to the end of an image forming process, and thus information can be written accurately without being affected by noise caused by supplying the AC voltage to the charging member, for example.

Further, in this image forming apparatus, the image forming apparatus may comprise a moving body provided with a plurality of the attach/detach sections, and an attach/detach opening through which the developing unit is attached to and detached from the attach/detach section; in a state in which the developing unit is positioned at an opposing position where the developing unit is in opposition to the photoconductor due to movement of the moving body, the latent image may be developed with the developer contained in the developing unit; in a state in which the developing unit is positioned at a detaching position that is different from the opposing position due to movement of the moving body, the developing unit may be detached from the attach/detach section via the attach/detach opening; and during a period from when the developing unit arrives at the opposing position until when the developing unit arrives at the detaching position due to movement of the moving body, the writing member may write information into the element of the developing unit.

If the image forming apparatus is provided with an attach/detach opening through which the developing unit is attached to and detached from the attach/detach section, then there is a possibility that a developing unit attached to the attach/detach section may carelessly be detached via the attach/detach opening. In particular, since the amount of developer in a developing unit decreases when the developing unit is positioned at the opposing position and development is carried out, if the developing unit is detached before information about the amount of developer that has decreased is written into its element, then it may not be possible to ascertain the amount of developer contained in the developing unit, for example.

Here, with the foregoing image forming device, the writing member writes information, such as the remaining amount of developer, into the element of the developing unit during a period from when the developing unit arrives at the opposing position until when the developing unit arrives at the detaching position due to movement of the moving body, and thus, information, such as the amount of developer contained in the developing unit, is written accurately without being affected by noise caused by supplying an AC voltage, for example, even if the developing unit is detached via the attach/detach opening.

Further, in this image forming apparatus, during a period from when the developer bearing body provided in the developing unit that has arrived at the opposing position ends developing the latent image until when the developing unit arrives at the detaching position, the writing member may write information into the element of the developing unit.

The amount of developer in the developing unit decreases when the latent image is developed by the developer bearing body provided in the developing unit. Here, with the foregoing image forming apparatus, the writing member writes information into the element of the developing unit during a period from when the developer bearing body provided in the developing unit that has arrived at the opposing position ends developing the latent image until when the developing unit arrives at the detaching position. Consequently, information, such as the remaining amount based on the amount of developer that has decreased through development, is written into the element of the developing unit.

Further, in this image forming apparatus, during a period from when the developing unit starts moving from the opposing position until when the developing unit arrives at the detaching position due to movement of the moving body, the writing member may write information into the element of the developing unit.

With this image forming apparatus, information can be written effectively using the period of time from when the developing unit starts moving from the opposing position until when the developing unit arrives at the detaching position due to movement of the moving body.

Further, in this image forming apparatus, if, during the period from when the developing unit starts moving from the opposing position until when the developing unit arrives at the detaching position, another developing unit adjacent to the developing unit on the upstream side therefrom in a direction of movement of the moving body arrives at the opposing position, then the writing member may write information into the element of the developing unit during a period until the other developing unit arrives at the opposing position.

With this image forming apparatus, the writing member writes information into the element of the developing unit during a period until the other developing unit arrives at the opposing position, and thus, information would already be written into the element, even if the developing unit is forcibly detached after the other developing unit has arrived at the opposing position, for example.

Further, in this image forming apparatus, a difference between a maximum voltage value and a minimum voltage value of the AC voltage may be 1000 volts or more.

When the difference between the maximum voltage value and the minimum voltage value of the AC voltage is 1000 volts or more, the electromagnetic noise that is generated also becomes large. With the foregoing image forming apparatus, the writing member writes information into the element of the developing unit attached to the attach/detach section when the AC voltage supply section is not supplying an AC voltage during the period from the start to the end of an image forming process, and thus information can be written accurately without being affected by the large noise caused by supplying the AC voltage, for example.

Further, in this image forming apparatus, the writing member may write information into the element in a non-contact state with respect to the element.

If the writing member writes information into the element in a non-contact state, then there is greater susceptibility to electromagnetic noise than in the case where the writing member writes information into the element in a state in which it contacts the element. With the foregoing image forming apparatus, the writing member writes information into the element of the developing unit attached to the attach/detach section when the AC voltage supply section is not supplying an AC voltage during the period from the start to the end of an image forming process, and thus information can be written accurately in a non-contact state without being affected by the large noise that is caused by supplying the AC voltage, for example.

Further, in this image forming apparatus, the writing member may write, into the element, information indicating a remaining amount of developer contained in the developing unit provided with the element.

Since the developer contained in the developing unit decreases as developing is carried out, it is preferable to appropriately write the remaining amount of developer into the element. Here, with this image forming apparatus, information about the remaining amount can be written accurately without being affected by the large noise caused by supplying the AC voltage, for example.

Further, in this image forming apparatus, the writing member may write, into the element, information indicating a usage amount of developer contained in the developing unit provided with the element.

Since the developer contained in the developing unit decreases as developing is carried out, it is preferable to appropriately write the usage amount of developer into the element. Here, with this image forming apparatus, information about the usage amount can be written accurately without being affected by the large noise caused by supplying the AC voltage, for example.

It is also possible to achieve an image forming apparatus comprising: an attach/detach section to and from which a developing unit having an element into which information can be written and a developer containing section can be attached and detached; a photoconductor on which a latent image can be formed; a writing member for writing information into the element; and an AC voltage supply section for supplying an AC voltage, wherein: the developing unit has a developer bearing body for bearing developer; the AC voltage supply section supplies an AC voltage to the developer bearing body; during a period from a start to an end of an image forming process, the writing member writes information into the element of the developing unit attached to the attach/detach section when the AC voltage supply section is not supplying an AC voltage to the developer bearing body; the image forming apparatus comprises a moving body provided with a plurality of the attach/detach sections, and an attach/detach opening through which the developing unit is attached to and detached from the attach/detach section; in a state in which the developing unit is positioned at an opposing position where the developing unit is in opposition to the photoconductor due to movement of the moving body, the latent image can be developed with the developer contained in the developing unit; in a state in which the developing unit is positioned at a detaching position that is different from the opposing position due to movement of the moving body, the developing unit can be detached from the attach/detach section via the attach/detach opening; during a period from when the developing unit starts moving from the opposing position until when the developing unit arrives at the detaching position due to movement of the moving body, the writing member writes information into the element of the developing unit; if, during the period from when the developing unit starts moving from the opposing position until when the developing unit arrives at the detaching position, another developing unit adjacent to the developing unit on the upstream side therefrom in a direction of movement of the moving body arrives at the opposing position, then the writing member writes information into the element of the developing unit during a period until the other developing unit arrives at the opposing position; a difference between a maximum voltage value and a minimum voltage value of the AC voltage is 1000 volts or more; the writing member writes information into the element in a non-contact state with respect to the element; and the writing member writes, into the element, information indicating a remaining amount or a usage amount of developer contained in the developing unit provided with the element.

The invention may also be an image forming apparatus comprising: a photoconductor unit attach/detach section to and from which a photoconductor unit having an element into which information can be written and a photoconductor can be attached and detached; a developing device for developing a latent image formed on the photoconductor; a writing member for writing information into the element; and an AC voltage supply section for supplying an AC voltage, wherein, during a period from a start to an end of an image forming process, the writing member writes information into the element of the photoconductor unit attached to the photoconductor unit attach/detach section when the AC voltage supply section is not supplying an AC voltage.

If a photoconductor unit, which has an element into which information can be written and a photoconductor, is configured so that it can be attached to and detached from an photoconductor attach/detach section, then there is a possibility that the photoconductor unit attached to the attach/detach section will become detached. Consequently, it is preferable that information about the photoconductor unit is suitably written into the element of that photoconductor unit. On the other hand, if an AC voltage supply section for supplying an AC voltage is provided, then when the AC voltage supply section is supplying an AC voltage, there is a possibility that electromagnetic noise will be generated in the periphery of the AC voltage supply section.

With the foregoing image forming apparatus, the writing member writes information into the element of the photoconductor unit attached to the photoconductor unit attach/detach section when the AC voltage supply section is not supplying an AC voltage during the period from the start to the end of an image forming process, and thus information can be written accurately without being affected by noise caused by supplying the AC voltage, for example.

Further, in this image forming apparatus, the developing device may have a developer bearing body for bearing developer; and the AC voltage supply section may supply an AC voltage to the developer bearing body.

With this image forming apparatus, the writing member writes information into the element of the photoconductor unit attached to the photoconductor attach/detach section when the AC voltage supply section is not supplying an AC voltage to the developer bearing body during the period from the start to the end of an image forming process, and thus information can be written accurately without being affected by noise caused by supplying the AC voltage to the developer bearing body, for example.

Further, in this image forming apparatus, the photoconductor unit may have a charging member for charging the photoconductor; and the AC voltage supply section may supply an AC voltage to the charging member.

With this image forming apparatus, the writing member writes information into the element of the photoconductor unit attached to the photoconductor attach/detach section when the AC voltage supply section is not supplying an AC voltage to the charging member during the period from the start to the end of an image forming process, and thus information can be written accurately without being affected by noise caused by supplying the AC voltage to the charging member, for example.

Further, in this image forming apparatus, the developing device may be a developing unit that is provided as a unit; the image forming apparatus may comprise a moving body provided with a plurality of developing unit attach/detach sections to and from which the developing unit can be attached and detached, and an attach/detach opening through which the developing unit is attached to and detached from the developing unit attach/detach section; in a state in which the developing unit is positioned at an opposing position where the developing unit is in opposition to the photoconductor due to movement of the moving body, the latent image on the photoconductor may be developed with the developer contained in the developing unit; in a state in which the developing unit is positioned at a detaching position that is different from the opposing position due to movement of the moving body, the developing unit may be detached from the developing unit attach/detach section via the attach/detach opening; and during a period from when the developing unit arrives at the opposing position until when the developing unit arrives at the detaching position due to movement of the moving body, the writing member may write information into the element of the photoconductor unit.

If the developing unit, which has a developer containing section, is configured so that it can be attached to and detached from the developing unit attach/detach section, then there is a possibility that the developing unit attached to the developing unit attach/detach section may carelessly be detached via the attach/detach opening. In this case, if the photoconductor unit has an element and information about the developing unit is written into this element, then there is a possibility that information stored in the element may be incorrect if the developing unit is carelessly detached via the attach/detach opening.

Here, with the foregoing image forming device, the writing member writes information into the element of the photoconductor unit, without being affected by noise etc., during a period from when the developing unit arrives at the opposing position until when the developing unit arrives at the detaching position due to movement of the moving body, and thus, even if the developer unit is carelessly detached via the attach/detach opening, it is possible to prevent the accuracy of the information stored in the element from being impaired.

Further, in this image forming apparatus, during a period from when the developer bearing body provided in the developing unit that has arrived at the opposing position ends developing the latent image until when the developing unit arrives at the detaching position, the writing member may write information into the element of the photoconductor unit.

The amount of developer in the developing unit decreases when the latent image is developed by the developer bearing body provided in the developing unit. Here, with the foregoing image forming apparatus, the writing member writes information into the element of the photoconductor unit during a period from when the developer bearing body provided in the developing unit that has arrived at the opposing position ends developing the latent image until when the developing unit arrives at the detaching position. Consequently, for example, it becomes possible to write information, such as the remaining amount based on the amount of developer that has decreased through development, into the element of the photoconductor unit.

Further, in this image forming apparatus, during a period from when the developing unit starts moving from the opposing position until when the developing unit arrives at the detaching position due to movement of the moving body, the writing member may write information into the element of the photoconductor unit.

With this image forming apparatus, information can be written effectively using the period of time from when the developing unit starts moving from the opposing position until when the developing unit arrives at the detaching position due to movement of the moving body.

Further, in this image forming apparatus, if, during the period from when the developing unit starts moving from the opposing position until when the developing unit arrives at the detaching position, another developing unit adjacent to the developing unit on the upstream side therefrom in a direction of movement of the moving body arrives at the opposing position, then the writing member may write information into the element of the photoconductor unit during a period until the other developing unit arrives at the opposing position.

With this image forming apparatus, the writing member writes information into the element of the developing unit during a period until the other developing unit arrives at the opposing position, and thus, information would already be written into the element, even if the developing unit is forcibly detached after the other developing unit has arrived at the opposing position, for example.

Further, in this image forming apparatus, a difference between a maximum voltage value and a minimum voltage value of the AC voltage may be 1000 volts or more.

When the difference between the maximum voltage value and the minimum voltage value of the AC voltage is 1000 volts or more, the electromagnetic noise that is generated also becomes large. With the foregoing image forming apparatus, the writing member writes information into the element of the photoconductor unit attached to the photoconductor attach/detach section when the AC voltage supply section is not supplying an AC voltage during the period from the start to the end of an image forming process, and thus information can be written accurately without being affected by the large noise caused by supplying the AC voltage, for example.

Further, in this image forming apparatus, the writing member may write information into the element in a non-contact state with respect to the element.

If the writing member writes information into the element in a non-contact state, then there is greater susceptibility to electromagnetic noise than in the case where the writing member writes information into the element in a state in which it contacts the element. With the foregoing image forming apparatus, the writing member writes information into the element of the photoconductor unit attached to the photoconductor attach/detach section when the AC voltage supply section is not supplying an AC voltage during the period from the start to the end of an image forming process, and thus information can be written accurately in a non-contact state without being affected by the large noise that is caused by supplying the AC voltage, for example.

It is also possible to achieve a computer system comprising: a computer unit; and an image forming apparatus connected to the computer unit, the image forming apparatus including: an attach/detach section to and from which a developing unit having an element into which information can be written and a developer bearing body can be attached and detached; a photoconductor on which a latent image can be formed; a writing member for writing information into the element; and an AC voltage supply section for supplying an AC voltage, wherein, during a period from a start to an end of an image forming process, the writing member writes information into the element of the developing unit attached to the attach/detach section when the AC voltage supply section is not supplying an AC voltage.

It is also possible to achieve a computer system comprising: a computer unit; and an image forming apparatus connected to the computer unit, the image forming apparatus including: a photoconductor unit attach/detach section to and from which a photoconductor unit having an element into which information can be written and a photoconductor can be attached and detached; a developing device for developing a latent image formed on the photoconductor; a writing member for writing information into the element; and an AC voltage supply section for supplying an AC voltage, wherein, during a period from a start to an end of an image forming process, the writing member writes information into the element of the photoconductor unit attached to the photoconductor unit attach/detach section when the AC voltage supply section is not supplying an AC voltage.

A developing unit comprises: a developer bearing body including a rotating shaft and a large diameter section that has a diameter larger than a diameter of the rotating shaft and that is for bearing developer, wherein the developer bearing body is capable of rotating about the rotating shaft; an element with which communication is possible; and a developer containing section for containing developer, wherein the element is provided more to the outside than the large diameter section in an axial direction of the rotating shaft.

With the foregoing developing unit, the element is provided more to the outside than the large diameter section in an axial direction of the rotating shaft, and thus, even if electromagnetic noise is generated due, for example, to an AC voltage being applied to the developer bearing body, the negative influence of the noise on communication can be reduced, and it becomes possible to achieve accurate communication with the element.

Further, the rotating shaft and the large diameter section may have conductivity, and an AC voltage may be applied to them.

In such a case, since the degree to which the electromagnetic noise affects communication is conspicuous, the above-described effects, that is, the effect that it becomes possible to reduce the negative influence that the electromagnetic noise has on communication and the effect that it becomes possible to achieve accurate communication with the element are more effectively achieved.

Further, the developing unit may comprise a housing for forming the developer containing section; and the element may be provided on the housing.

In such a case, it is possible to achieve a developing unit in which the element is provided at an easily attachable position.

Further, the developing unit may be capable of being attached to and detached from one of a plurality of attach/detach sections which are provided in a rotating body of an image forming apparatus body and to and from which the developing unit can be attached and detached; and the element may be positioned more to the outside than a developing unit body, which includes the developer bearing body and the developer containing section, in a radial direction of rotation of the rotating body when the developing unit is attached to the attach/detach section.

In such a case, since the element is arranged more to the outside than a developing unit body in a radial direction of rotation of the rotating body, it becomes even easier to attach the element.

Further, the developing unit may be capable of being attached to and detached from one of a plurality of attach/detach sections which are provided in a rotating body of an image forming apparatus body and to and from which the developing unit can be attached and detached, the image forming apparatus body further including an antenna for wirelessly communicating with the element of the developing unit attached to one of the attach/detach sections; and the element may be positioned more to the inside than the antenna in a radial direction of rotation of the rotating body when the developing unit is attached to the attach/detach section.

In such a case, since the element is arranged more to the inside than the antenna in a radial direction of rotation of the rotating body, it also becomes easy to attach the antenna of the body for development.

Next, an image forming apparatus comprises: a developing unit including a developer bearing body including a rotating shaft and a large diameter section that has a diameter larger than a diameter of the rotating shaft and that is for bearing developer, wherein the developer bearing body is capable of rotating about the rotating shaft, an element with which communication is possible, and a developer containing section for containing developer; an attach/detach section to and from which the developing unit can be attached and detached; and an antenna for wirelessly communicating with the element of the developing unit attached to the attach/detach section, wherein the element is provided more to the outside than the large diameter section in an axial direction of the rotating shaft.

With the foregoing image forming apparatus, the element is provided more to the outside than the large diameter section in an axial direction of the rotating shaft, and thus, even if electromagnetic noise is generated due, for example, to an AC voltage being applied to the developer bearing body, the negative influence of the noise on communication can be reduced, and it becomes possible to achieve accurate communication with the element.

Further, the rotating shaft and the large diameter section may have conductivity, and an AC voltage may be applied to them.

In such a case, since the degree to which the electromagnetic noise affects communication is conspicuous, the above-described effects, that is, the effect that it becomes possible to reduce the negative influence that the electromagnetic noise has on communication and the effect that it becomes possible to achieve accurate communication with the element are more effectively achieved.

Further, the developing unit may have a housing for forming the developer containing section, and the element may be provided on the housing.

In such a case, it is possible to achieve an image forming apparatus in which the element is provided at an easily attachable position.

Further, the element may be positioned more to the outside than a developing unit body, which includes the developer bearing body and the developer containing section, in a radial direction of rotation of the rotating body when the developing unit is attached to the attach/detach section.

In such a case, since the element is arranged more to the outside than a developing unit body in a radial direction of rotation of the rotating body, it becomes even easier to attach the element.

Further, the element may be positioned more to the inside than the antenna in a radial direction of rotation of the rotating body when the developing unit is attached to the attach/detach section.

In such a case, since the element is arranged more to the inside than the antenna in a radial direction of rotation of the rotating body, it also becomes easy to attach the antenna of the body for development.

Further, the image forming apparatus may comprise an attach/detach opening through which the developing unit is attached to and detached from the attach/detach section, and a photoconductor on which a latent image can be formed; in a state in which the developing unit is positioned at an opposing position where the developing unit is in opposition to the photoconductor due to rotation of the rotating body, the latent image may be developed with the developer contained in the developing unit; in a state in which the developing unit is positioned at a detaching position that is different from the opposing position due to rotation of the rotating body, the developing unit may be detached from the attach/detach section via the attach/detach opening; and during a period from when the developing unit arrives at the opposing position until when the developing unit arrives at the detaching position due to rotation of the rotating body, the image forming apparatus may write information into the element of the developing unit using the antenna.

If the image forming apparatus is provided with an attach/detach opening through which the developing unit is attached to and detached from the attach/detach section, then there is a possibility that a developing unit attached to the attach/detach section may carelessly be detached via the attach/detach opening. In particular, since the amount of developer in a developing unit decreases when the developing unit is positioned at the opposing position and development is carried out, if the developing unit is detached before information about the amount of developer that has decreased is written into its element, then it may not be possible to ascertain the amount of developer contained in the developing unit, for example.

It becomes possible to solve the this problem in cases such as those described above.

Further, the image forming apparatus may comprise an AC voltage supply section for supplying an AC voltage; and the image forming apparatus may write information into the element of the developing unit attached to the attach/detach section using the antenna when the AC voltage supply section is supplying an AC voltage to the developer bearing body.

In such a case, since there is an increased possibility that the electromagnetic noise will negatively affect communication because information is written into the element when the AC voltage supply section is supplying an AC voltage to the developer bearing body, the above-described effects, that is, the effect that it becomes possible to reduce the negative influence that the electromagnetic noise has on communication and the effect that it becomes possible to achieve accurate communication with the element are more effectively achieved.

Further, a difference between a maximum voltage value and a minimum voltage value of the AC voltage may be 1000 volts or more.

When the difference between the maximum voltage value and the minimum voltage value of the AC voltage is 1000 volts or more, the electromagnetic noise that is generated also becomes large, and therefore, the above-described effects, that is, the effect that it becomes possible to reduce the negative influence that the electromagnetic noise has on communication and the effect that it becomes possible to achieve accurate communication with the element are more effectively achieved.

Further, the antenna may be capable of communicating with the element in a non-contact state with respect to the element.

In such a case, since the environment pertaining to the communication between the antenna and the element is severe compared to a case where, for example, communication is carried out in a state in which they are in contact with each other, the above-described effects, that is, the effect that it becomes possible to reduce the negative influence that the electromagnetic noise has on communication and the effect that it becomes possible to achieve accurate communication with the element are more effectively achieved.

It is also possible to achieve an image forming apparatus comprising: a developing unit including a developer bearing body including a rotating shaft and a large diameter section that has a diameter larger than a diameter of the rotating shaft and that is for bearing developer, wherein the developer bearing body is capable of rotating about the rotating shaft, an element with which communication is possible, and a developer containing section for containing developer; an attach/detach section to and from which the developing unit can be attached and detached; and an antenna for wirelessly communicating with the element of the developing unit attached to the attach/detach section, wherein: the element is provided more to the outside than the large diameter section in an axial direction of the rotating shaft; the rotating shaft and the large diameter section have conductivity, and an AC voltage is applied to them; the developing unit has a housing for forming the developer containing section, and the element is provided on the housing; the element is positioned more to the outside than a developing unit body, which includes the developer bearing body and the developer containing section, in a radial direction of rotation of the rotating body when the developing unit is attached to the attach/detach section; the element is positioned more to the inside than the antenna in a radial direction of rotation of the rotating body when the developing unit is attached to the attach/detach section; the image forming apparatus comprises an attach/detach opening through which the developing unit is attached to and detached from the attach/detach section, and a photoconductor on which a latent image can be formed; in a state in which the developing unit is positioned at an opposing position where the developing unit is in opposition to the photoconductor due to rotation of the rotating body, the latent image can be developed with the developer contained in the developing unit; in a state in which the developing unit is positioned at a detaching position that is different from the opposing position due to rotation of the rotating body, the developing unit can be detached from the attach/detach section via the attach/detach opening; during a period from when the developing unit arrives at the opposing position until when the developing unit arrives at the detaching position due to rotation of the rotating body, the image forming apparatus writes information into the element of the developing unit using the antenna; the image forming apparatus comprises an AC voltage supply section for supplying an AC voltage; the image forming apparatus writes information into the element of the developing unit attached to the attach/detach section using the antenna when the AC voltage supply section is supplying an AC voltage to the developer bearing body; a difference between a maximum voltage value and a minimum voltage value of the AC voltage is 1000 volts or more; and the antenna is capable of communicating with the element in a non-contact state with respect to the element.

It is also possible to achieve a computer system comprising: a computer unit; a display device that is capable of being connected to the computer unit; and an image forming apparatus that is capable of being connected to the computer unit, the image forming apparatus including: a developing unit including a developer bearing body including a rotating shaft and a large diameter section that has a diameter larger than a diameter of the rotating shaft and that is for bearing developer, wherein the developer bearing body is capable of rotating about the rotating shaft, an element with which communication is possible, and a developer containing section for containing developer; an attach/detach section to and from which the developing unit can be attached and detached; and an antenna for wirelessly communicating with the element of the developing unit attached to the attach/detach section, wherein the element is provided more to the outside than the large diameter section in an axial direction of the rotating shaft.

First Embodiment

===Overview of Image Forming Apparatus (Laser Beam Printer)===

Figure 2:
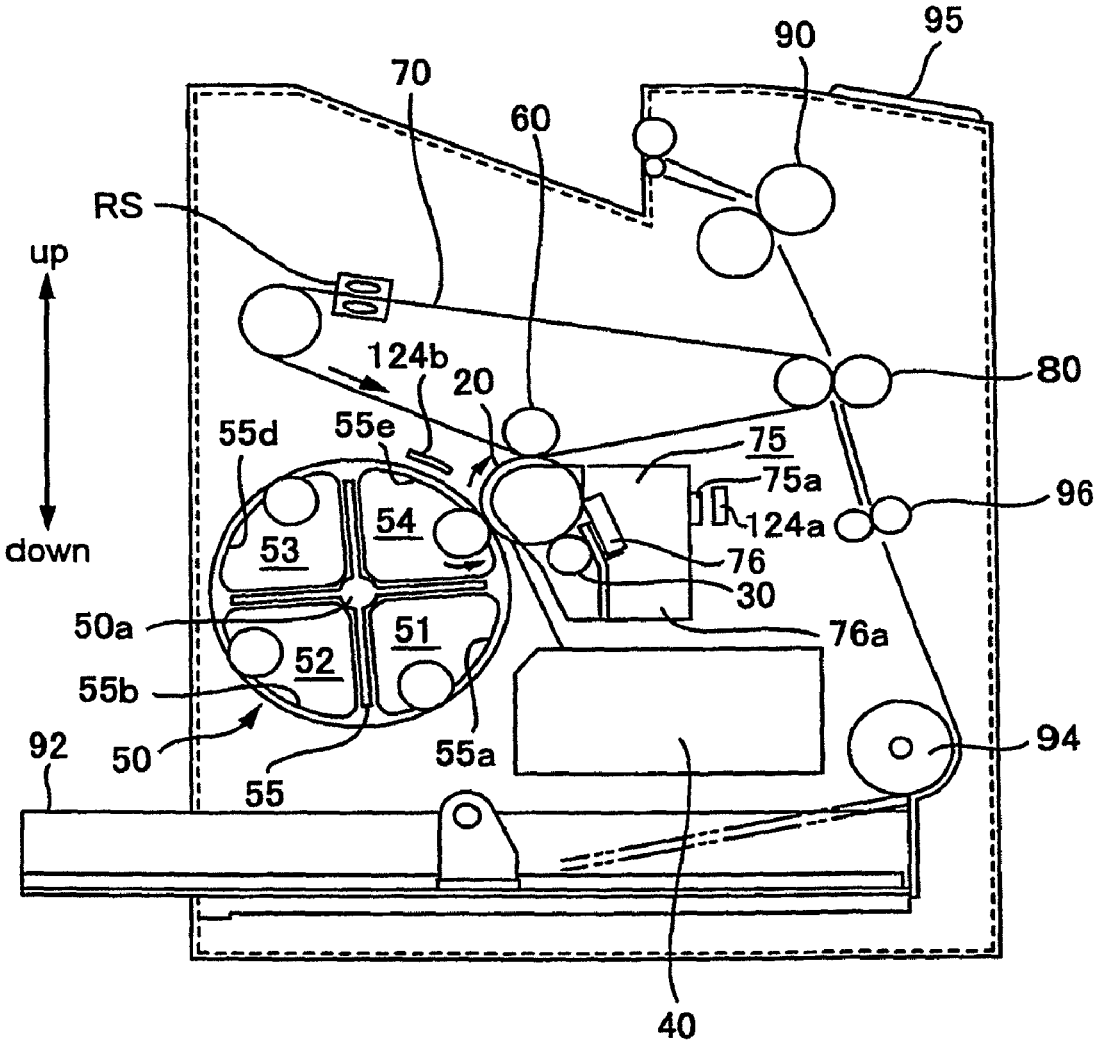
FIG. 2 is a diagram showing main structural components that configure a printer 10.

Next, using FIG. 1 and FIG. 2, an overview of a laser beam printer (herein after, also referred to as "printer") 10, taken as an example of the image forming apparatus, is described. FIG. 1 is a diagram for describing a configuration in which a developing unit 54 (51, 52, 53) and a photoconductor unit 75 are attached to and detached from a printer unit 10*a*. FIG. 2 is a diagram showing main structural components that configure the printer 10. It should be noted that FIG. 2 is a diagram of a cross section taken perpendicular to the X direction in FIG. 1. Further, the up/down direction is shown by an arrow in FIG. 1 and FIG. 2, and for example, a paper supply tray 92 is arranged at a lower section of the printer 10 and a fusing unit 90 is arranged at an upper section of the printer 10.

<Attach/Detach Configuration>

The developing unit 54 (51,52,53) and the photoconductor unit 75 can be attached to and detached from the printer unit 10*a*. The printer 10 is structured by attaching the developing unit 54 (51, 52, 53) and the photoconductor unit 75 to the printer unit 10*a*.

The printer unit 10*a* has a first open/close cover 10*b* that can be opened and closed, a second open/close cover 10*c* that can be opened and closed and that is provided more inward than the first open/close cover 10*b*, a photoconductor unit attach/detach opening 10*d* through which the photoconductor unit 75 is attached and detached, and a developing unit attach/detach opening 10*e* through which the developing unit 54 (51, 52, 53) is attached and detached.

Here, when the user opens the first open/close cover 10*b*, the photoconductor unit 75 can be attached to and detached from the printer unit 10*a* via the photoconductor unit attach/detach opening 10*d*. Further, when the user opens the second open/close cover 10*c*, the developing unit 54 (51, 52, 53) can be attached to and detached from the printer unit 10*a* via the developing unit attach/detach opening 10*e*.

<Overview of the Printer 10>

An overview of the printer 10 in a state in which the developing unit 54 (51, 52, 53) and the photoconductor unit 75 have been attached to the printer unit 10*a* is described.

As shown in FIG. 2, the printer 10 according to the present embodiment has a charging unit 30, an exposing unit 40, a YMCK developing device 50, a first transferring unit 60, an intermediate transferring body 70, and a cleaning blade 76, in the direction of rotation of a photoconductor 20, which is a latent image bearing body for bearing a latent image. It further includes a second transferring unit 80, a fusing unit 90, a display unit 95 made of a liquid crystal panel etc. for constituting a means for making a notification to the user, and a control unit 100 (FIG. 3) for controlling these units etc. so as to control the operation of the printer 10.

The photoconductor 20 has a cylindrical conductive base and a photo conductive layer formed on the outer circumference surface of this base, and can rotate about a central shaft. In this embodiment, the photoconductor rotates in the clockwise direction as shown by arrow in FIG. 2.

The charging unit 30 is a device for charging the photoconductor 20, and the exposing unit 40 is a device for forming a latent image on the charged photoconductor 20 by irradiating laser. The exposing unit 40 has, for example, a semiconductor laser, a polygon mirror, and an F-θ lens, and irradiates modulated laser onto the charged photoconductor 20 based on an image signal that is input from a not-shown host computer, such as a personal computer or a word processor.

The YMCK developing device 50 has a rotary 55, which serves as a moving body, and four developing units attached to the rotary 55. The rotary 55 is capable of rotating, and is provided with four attach/detach sections 55*b*, 55*c*, 55*d*, and 55*e* to and from which the four developing units 51, 52, 53, and 54 can respectively be attached and detached via the developing unit attach/detach opening 10*e*. The cyan developing unit 51, which contains cyan (C) toner, can be attached to and detached from the attach/detach section 55*b*, the magenta developing unit 52, which contains magenta (M)

toner, can be attached to and detached from the attach/detach section 55*c*, the black developing unit 53, which contains black (K) toner, can be attached to and detached from the attach/detach section 55*d*, and the yellow developing unit 54, which contains yellow (Y) toner, can be attached to and detached from the attach/detach section 55*e*.

By rotating, the rotary 55 moves the above-mentioned four developing units 51, 52, 53, and 54 that have been attached to the attach/detach sections 55*b*, 55*c*, 55*d*, and 55*e*, respectively. That is, the rotary 55 rotates the four attached developing units 51, 52, 53, and 54 about a central shaft 55*a* while maintaining their relative positions. Then, the developing units 51, 52, 53, and 54 are selectively brought into opposition with the latent image formed on the photoconductor 20 so as to develop the latent image on the photoconductor 20 using the toner contained in each of the developing units 51, 52, 53, and 54. It should be noted that the developing units are described in detail later.

The first transferring unit 60 is a device for transferring a single-color toner image formed on the photoconductor 20 onto the intermediate transferring body 70. When the four colors of toner are successively transferred over one another, a full-color toner image is formed on the intermediate transferring body 70.

The intermediate transferring body 70 is an endless belt and is rotatably driven at substantially the same circumferential velocity as the photoconductor 20. A read sensor for synchronization RS is provided near the intermediate transferring body 70. The read sensor for synchronization RS is a sensor for detecting the reference position of the intermediate transferring body 70, and obtains a synchronization signal Vsync in the sub-scanning direction, which is perpendicular to the main scanning direction. The read sensor for synchronization RS has a light-emitting section for emitting light and a light-receiving section for receiving light. Light that is emitted from the light-emitting section passes through a hole formed in a predetermined position of the intermediate transferring body 70, and when light is received by the light-receiving section, the read sensor for synchronization RS generates a pulse signal. One pulse signal is generated each time the intermediate transferring body 70 makes one revolution.

The second transferring unit 80 is a device for transferring the single-color toner image or the full-color toner image formed on the intermediate transferring body 70 onto a recording medium such as paper, film, or cloth.

The fusing unit 90 is a device for fusing the single-color toner image or the full-color toner image, which has been transferred onto the recording medium, onto the recording medium, such as paper, to make the image into a permanent image.

The cleaning blade 76 is made of rubber and abuts against the surface of the photoconductor 20. The cleaning blade 76 removes the toner remaining on the photoconductor 20 by scraping it off after the toner image has been transferred onto the intermediate transferring body 70 by the first transferring unit 60.

The photoconductor unit 75 is provided between the first transferring unit 60 and the exposing unit 40, and has the photoconductor 20, an element 75*a* to which information can be written, the charging unit 30, the cleaning blade 76, and a waste toner containing section 76*a* for containing toner that has been scraped off by the cleaning blade 76. It should be noted that the element 75*a* has a configuration that allows storage of various types of information that have been written in.

Figure 3:
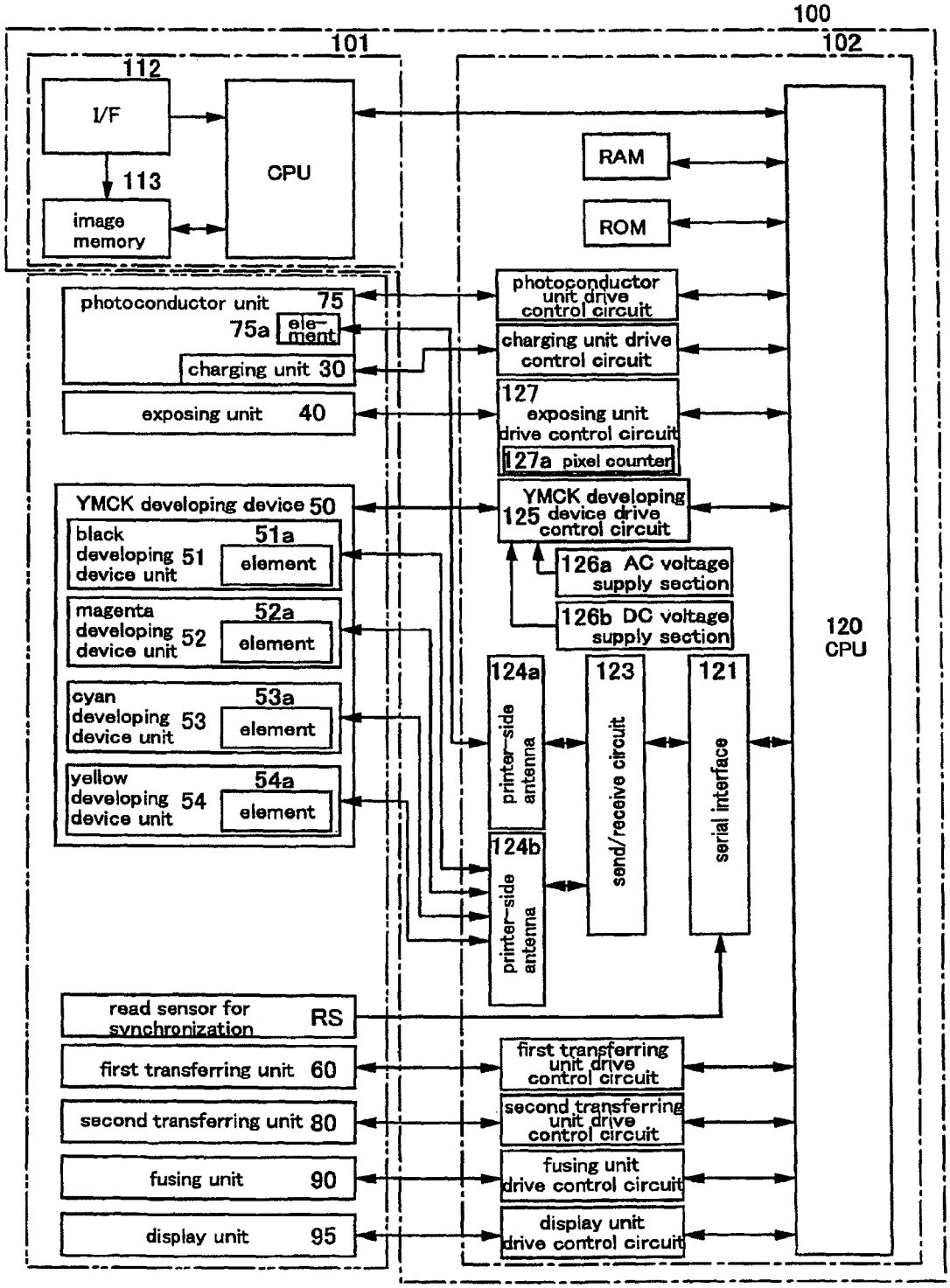
FIG. 3 is a block diagram showing a control unit 100 provided in the printer 10.

The control unit 100 is made of a main controller 101 and a unit controller 102, as shown in FIG. 3. An image signal is input to the main controller 101, and in accordance with a command based on this image signal, the unit controller 102 controls each of the above-mentioned units etc. to form an image.

===Operation of Printer 10===

Next, the operation of the printer 10 configured as above is described with reference to other structural components thereof.

First, when an image signal from a not-shown host computer is input to the main controller 101 of the printer 10 via an interface (I/F) 112, the photoconductor 20 and the intermediate transferring body 70 are rotated due to control by the unit controller 102 based on a command from the main controller 101. Then, the reference position of the intermediate transferring body 70 is detected by the read sensor for synchronization RS, and a pulse signal is output. This pulse signal is sent to the unit controller 102 via a serial interface 121. The unit controller 102 controls the following operation, taking the pulse signal, which has been received, as a reference.

While rotating, the photoconductor 20 is successively charged by the charging unit 30 at a charging position. The area of the photoconductor 20 that has been charged is brought to an exposing position through the rotation of the photoconductor 20, and a latent image corresponding to image information for a first color, for example, yellow Y, is formed in that area by the exposing unit 40.

The latent image formed on the photoconductor 20 is brought to a developing position through the rotation of the photoconductor 20, and is developed with yellow toner by the yellow developing unit 54. A yellow toner image is thus formed on the photoconductor 20.

The yellow toner image that has been formed on the photoconductor 20 is brought to a first transferring position through the rotation of the photoconductor 20 and is transferred onto the intermediate transferring body 70 by the first transferring unit 60. At this time, a first transferring voltage that has a polarity that is opposite from the toner-charge polarity is applied to the first transferring unit 60. It should be noted that throughout this operation, the second transferring unit 80 is separated from the intermediate transferring body 70.

The above process is repeated for the second color, the third color, and the fourth color, and therefore, toner images of each color corresponding to each of the image signals are transferred onto the intermediate transferring body 70 in a superposed manner. Thus, a full-color toner image is formed on the intermediate transferring body 70.

The full-color toner image that has been formed on the intermediate transferring body 70 is brought to a second transferring position through the rotation of the intermediate transferring body 70 and is transferred onto a recording medium by the second transferring unit 80. It should be noted that the recording medium is carried from the paper supply tray 92 to the second transferring unit 80 via a paper supply roller 94 and a resist roller 96. Further, when performing the transferring operation, the second transferring unit 80 is pressed against the intermediate transferring body 70 and supplied with a second transferring voltage.

The fusing unit 90 heats and applies pressure to the full-color toner image that has been transferred to the recording medium, and the image is fused to the recording medium.

On the other hand, after the photoconductor 20 passes the first transferring position, the toner adhering to its surface is scraped off by the cleaning blade 76 and it is prepared for charging for forming the next latent image. The toner that has been scraped off is collected in the waste toner containing section 76*a*.

===Overview of Control Unit===

Next, the configuration of the control unit 100 is described with reference to FIG. 3. FIG. 3 is a block diagram showing the control unit 100 provided in the printer 10.

The main controller 101 of the control unit 100 is connected to a host computer via the interface 112, and is provided with an image memory 113 for storing image signals that are received from the host computer.

The unit controller 102 of the control unit 100 is electrically connected to each of the units (the charging unit 30, the exposing unit 40, the first transferring unit 60, the photoconductor unit 75, the second transferring unit 80, the fusing unit 90, and the display unit 95) and the YMCK developing device 50, and by receiving signals from the sensors provided in these components, the unit controller controls each of these units and the YMCK developing device 50 based on signals input from the main controller 101 as it detects the state of each of these units and the YMCK developing device 50. As the structural components for driving each of these units and the YMCK developing device 50, FIG. 3 shows a photoconductor unit drive control circuit, a charging unit drive control circuit, an exposing unit drive control circuit 127, a YMCK developing device drive control circuit 125, a first transferring unit drive control circuit, a second transferring unit drive control circuit, a fusing unit drive control circuit, and a display unit drive control circuit.

The exposing unit drive control circuit 127 connected to the exposing unit 40 has a pixel counter 127*a* that serves as consumption amount detection means for detecting the amount of consumption of developer. The pixel counter 127*a* counts the number of pixels that are input to the exposing unit 40. It should be noted that it is also possible to provide the pixel counter 127*a* in the exposing unit 40 or in the main controller 101. It should be noted that the number of pixels is the number of pixels in units of basic resolution of the printer 10, or in other words, the number of pixels of the image that is actually printed. The amount of consumption of toner T (the usage amount) is proportional to the number of pixels, and therefore, by counting the number of pixels, it is possible to detect the amount of consumption of toner T.

To the YMCK developing device drive control circuit 125, an AC voltage is supplied from an AC voltage supply section 126*a* and a DC voltage is supplied from a DC voltage supply section 126*b*. The YMCK developing device drive control circuit 125 applies a voltage, which is obtained by superimposing the AC voltage and the DC voltage, to a developing roller at a suitable timing to form an alternating electric field between the developing roller and the photoconductor.

Further, the CPU 120 provided in the unit controller 102 is connected to a nonvolatile storage element (herein after, also referred to as "printer-side memory") 122 such as a serial EEPROM via the serial interface (I/F) 121.

Further, the CPU 120 is capable of wirelessly communicating with elements 51*a*, 52*a*, 53*a*, and 54*a* respectively provided in/on the developing units 51, 52, 53, and 54 via the serial interface 121, a send/receive circuit 123, and a printer-side antenna (antenna for communicating with the developing unit elements) 124*b* that serves as an antenna for wirelessly communicating with the elements of the developing units. The CPU 120 is also capable of wirelessly communicating with the element 75*a* of the photoconductor unit 75 via the serial interface 121, the send/receive circuit 123, and a printer-side antenna (antenna for communicating with the photoconductor unit element) 124*a*. At the time of wireless communication, the antenna 124*b* for communicating with the developing unit elements, which serves as a writing member (writing means), writes information into the elements 51*a*, 52*a*, 53*a*, and 54*a* of the developing units 51, 52, 53, and 54, respectively. The antenna 124*b* for communicating with the developing unit elements is also capable of reading information from the elements 51*a*, 52*a*, 53*a*, and 54*a* of the developing units 51, 52, 53, and 54, respectively. At the time of wireless communication, the antenna 124*a* for communicating with the photoconductor unit element, which serves as a writing member (writing means), writes information into the element 75*a* of the photoconductor unit 75. The antenna 124*a* for communicating with the photoconductor unit element can also read information from the element 75*a* of the photoconductor unit 75.

===Overview of Developing Units===

Figure 4:
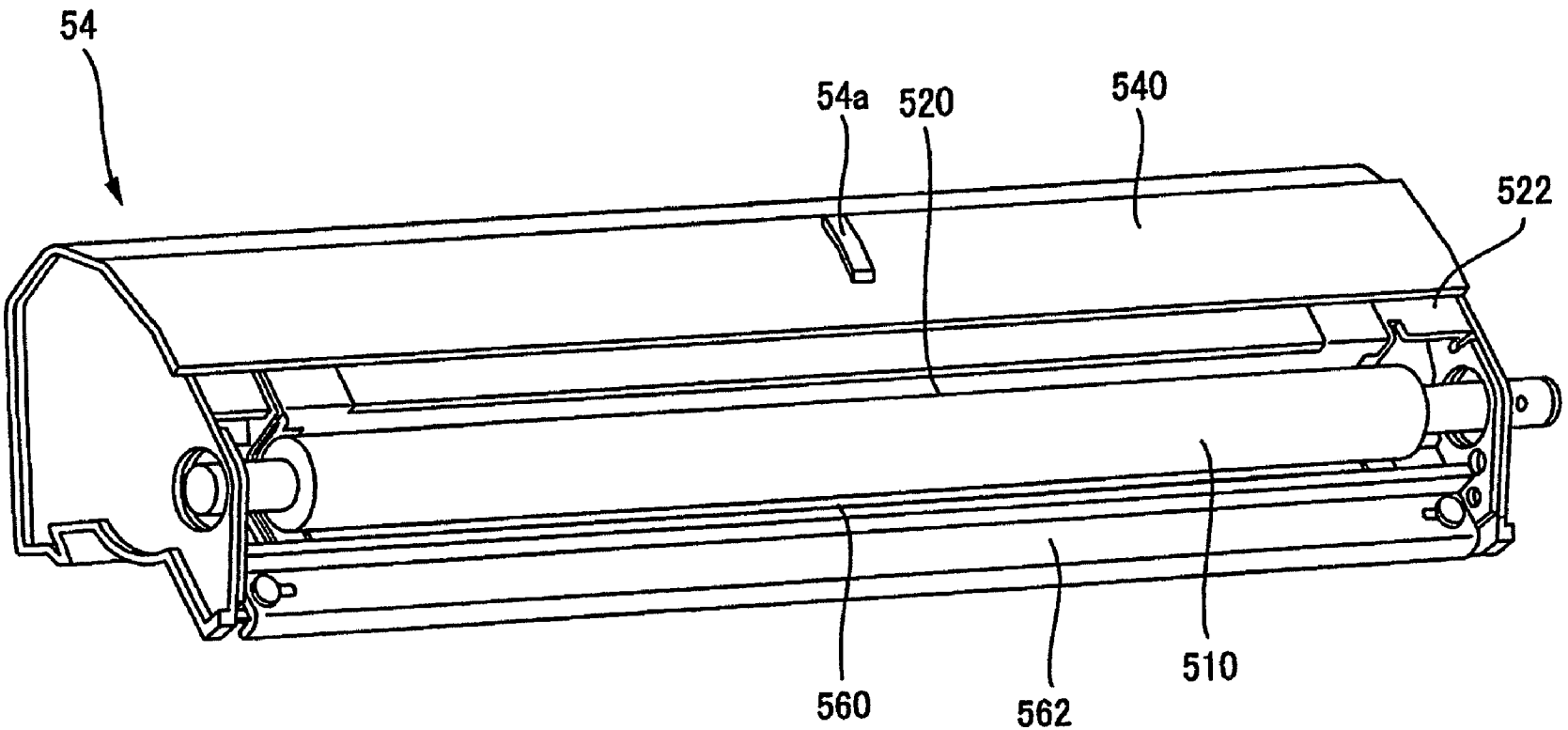
FIG. 4 is a perspective view of a yellow developing unit 54 seen from the side of a developing roller 510.
Figure 5:
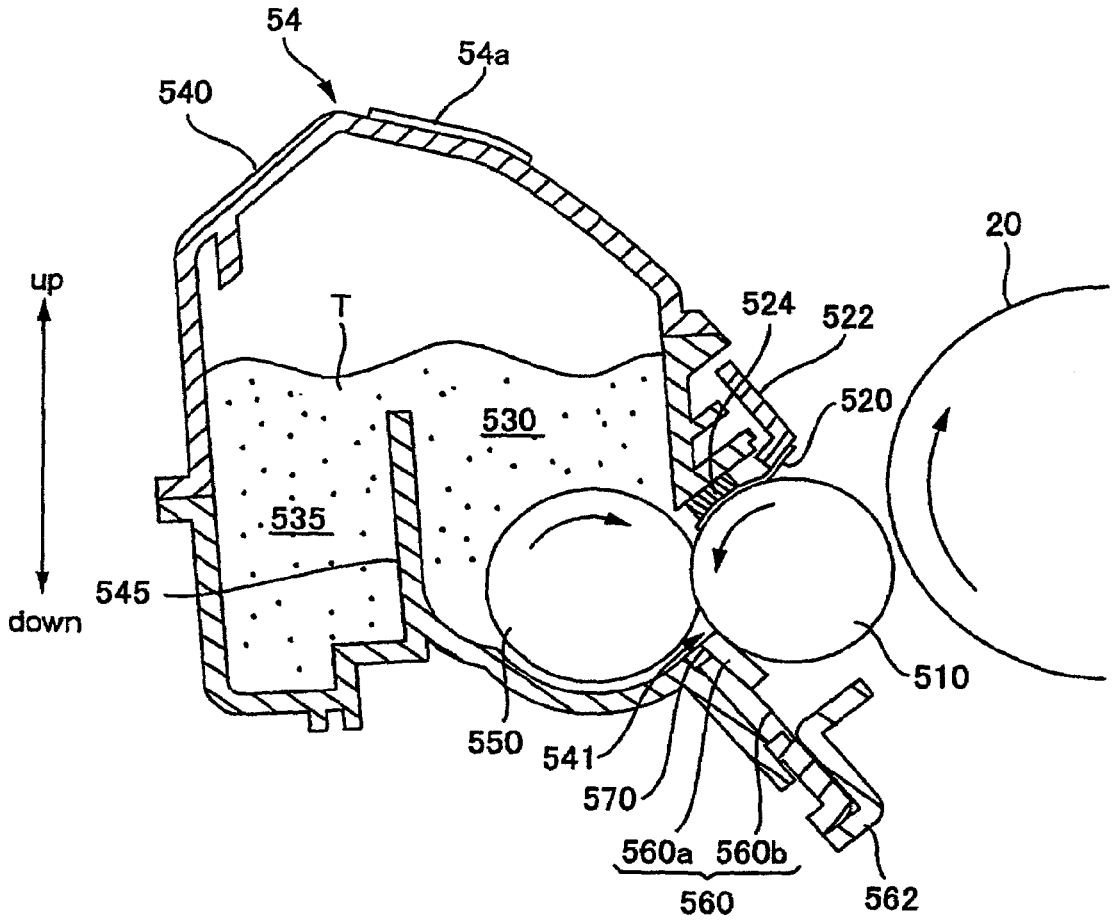
FIG. 5 is a cross-sectional view showing main structural components of the yellow developing unit 54.

Next, an overview of the developing units is described using FIG. 4 and FIG. 5. FIG. 4 is a perspective view of the yellow developing unit 54 seen from the side of a developing roller 510. FIG. 5 is a cross-sectional view showing main structural components of the yellow developing unit 54. It should be noted that in FIG. 5 as well, the up/down direction is shown by an arrow, and for example, the central axis of the developing roller 510 is located lower than the central axis of the photoconductor 20. Further, in FIG. 5, the yellow developing unit 54 is shown in a state in which it is positioned at a developing position that is in opposition to the photoconductor 20.

The YMCK developing device 50 is provided with the cyan developing unit 51, which contains cyan (C) toner, the magenta developing unit 52, which contains magenta (M) toner, the black developing unit 53, which contains black (K) toner, and the yellow developing unit 54, which contains yellow (Y) toner. Since the configuration of each of these developing units is the same, the yellow developing unit 54 is described below.

The yellow developing unit 54 is provided with, for example, a developer containing section, that is, a first containing section 530 and a second containing section 535 for containing yellow toner T which serves as the developer, the element 54*a*, a housing 540 for forming the developer containing section, the developing roller 510 which serves as the developer bearing body, a toner supply roller 550 for supplying toner T to the developing roller 510, and a restriction blade 560 for restricting the thickness of the layer of toner T that is bore on the developing roller 510.

The housing 540 is manufactured by joining, for example, an upper housing and a lower housing which have been integrally molded, and the inside of the housing is divided into the first containing section 530 and the second containing section 535 by a restriction wall 545 that extends upward from the lower section (in the up/down direction of FIG. 5). The first containing section 530 and the second containing section 535 form developer containing sections (530, 535) for containing toner T which serves as a developer. The upper sections of the first containing section 530 and the second containing section 535 are in communication, and the movement of the toner T between them is restricted by the restriction wall 545. It should be noted that it is also possible to provide a stirring member for stirring the toner T contained in the first containing section 530 and the second containing section 535. In the present embodiment, however, each of the developing units (the cyan developing unit 51, the magenta developing unit 52, the black developing unit 53, and the yellow developing unit 54) rotates in conjunction with the rotation of the rotary 55 so that the toner T in each developing unit is stirred. Therefore, a stirring member is not provided in the first containing section 530 or the second containing section 535.

The element 54*a*, into which information can be written, is provided on the outer surface of the housing 540. The element 54*a* has a configuration that allows storage of information that has been written in, and details thereof will be described later.

An opening 541 that communicates with the outside of the housing 540 is provided in the lower section of the first containing section 530. The toner supply roller 550 is provided in the first containing section 530 with its circumferential surface facing the opening 541, and is rotatably supported on the housing 540. Further, the developing roller 510 is provided with its circumferential surface facing the opening 541 from outside the housing 540, and the developing roller 510 abuts against the toner supply roller 550.

The developing roller 510 bears toner T and carries the toner to a developing position, which is in opposition to the photoconductor 20. The developing roller 510 is made of, for example, aluminum, stainless steel, or iron, and if necessary, it can be subjected to nickel plating or chromium plating, and the toner bearing region can be subjected to sandblasting or the like. Further, the developing roller 510 can rotate about its central axis, and as shown in FIG. 5, it rotates in the opposite direction (in FIG. 5, the counterclockwise direction) to the rotating direction of the photoconductor 20 (in FIG. 5, the clockwise direction). Its central axis is located lower than the central axis of the photoconductor 20. Further, as shown in FIG. 5, in a state in which the yellow developing unit 54 is in opposition to the photoconductor 20, a gap exists between the developing roller 510 and the photoconductor 20. That is, the yellow developing unit 54 develops the latent image formed on the photoconductor 20 in a non-contacting state. It should be noted that when the latent image formed on the photoconductor 20 is developed, an alternating electric field is generated between the developing roller 510 and the photoconductor 20.

The toner supply roller 550 supplies, to the developing roller 510, the toner T contained in the first containing section 530 and the second containing section 535. The toner supply roller 550 is made of polyurethane foam, for example, and abuts against the developing roller 510 in a state in which it is elastically deformed. The toner supply roller 550 is arranged at a lower section of the first containing section 530, and the toner T contained in the first containing section 530 and the second containing section is supplied to the developing roller 510 by the toner supply roller 550 at the lower section of the first containing section 530. The toner supply roller 550 can rotate about its central axis, and its central axis is located lower than the central rotation axis of the developing roller 510. Further, the toner supply roller 550 rotates in the opposite direction (in FIG. 5, the clockwise direction) to the rotating direction of the developing roller 510 (in FIG. 5, the counterclockwise direction). It should be noted that the toner supply roller 550 has the function of supplying the toner T that is contained in the first containing section 530 and the second containing section 535 to the developing roller 510 as well as the function of stripping off, from the developing roller 510, the toner T that remains on the developing roller 510 after development.

The restriction blade 560 restricts the thickness of the toner T layer bore by the developing roller 510, and gives charge to the toner T bore by the developing roller 510. The restriction blade 560 has a rubber section 560*a* and a rubber support section 560*b*. The rubber section 560*a* is made of, for example, silicone rubber or urethane rubber, and the rubber support section 560*b* is a thin plate made of, for example, phosphor bronze or stainless steel, and has a springy characteristic. The rubber section 560*a* is supported by the rubber support section 560*b*, and one end of the rubber support section 560*b* is fixed to a blade support metal plate 562. The blade support metal plate 562 is fastened to a seal frame 526, which is described later, and is attached to the housing 540 together with the restriction blade 560, forming a part of a seal unit 520, which is described later. In this state, the rubber section 560*a* is pressed against the developing roller 510 by the elastic force created by the flexure of the rubber support section 560*b*.

Further, a blade backing member 570 made of Moltoprene or the like is provided on one side of the restriction blade 560 opposite from the side of developing roller 510. The blade backing member 570 prevents the toner T from entering in between the rubber support section 560*b* and the housing 540 to stabilize the elastic force caused by the flexure of the rubber support section 560*b*, and also presses the rubber section 560*a* against the developing roller 510 by applying force to the rubber section 560*a* toward the developing roller 510 from directly behind the rubber section 560*a*. Consequently, the blade backing member 570 improves the contact uniformity and the sealing properties of the rubber section 560*a* with respect to the developing roller 510.

The end of the restriction blade 560 on the side opposite from the side supported by the blade support metal plate 562, that is, its tip, is not in contact with the developing roller 510; rather, a section at a predetermined distance from its tip contacts, with some breadth, the developing roller 510. That is, the restriction blade 560 does not abut against the developing roller 510 at its edge but rather at its mid section. Further, the restriction blade 560 is arranged such that its tip is facing upstream in the rotating direction of the developing roller 510, and thus, makes a so-called counter-abutment with respect to the roller. It should be noted that the abutting position where the restriction blade 560 abuts against the developing roller 510 is located lower than the central axis of the developing roller 510 and is also located lower than the central axis of the toner supply roller 550.

The seal member 520 prevents the toner T in the yellow developing unit 54 from spilling out from the unit, and also collects the toner T on the developing roller 510, which has passed the developing position, into the developing unit without scraping it off. The seal member 520 is a seal made of polyethylene film or the like. The seal member 520 is supported by a seal support metal plate 522, and is attached to the frame 540 via the seal support metal plate 522. A seal urging member 524 made of Moltoprene or the like is provided on one side of the seal member 520 opposite from the side of the developing roller 510, and due to the elastic force of the seal urging member 524, the seal member 520 is pressed against the developing roller 510. It should be noted that the abutting position where the seal member 520 abuts against the developing roller 510 is located above the central axis of the developing roller 510.

In the yellow developing unit 54 configured in this manner, the toner supply roller 550 supplies, to the developing roller 510, the toner T that is contained in the first containing section 530 and the second containing section 535, which serve as developer containing sections. The toner T that is supplied to the developing roller 510 is brought to the abutting position of the restriction blade 560 in conjunction with the rotation of the developing roller 510, and when it passes the abutting position, the thickness of the toner layer is restricted and the toner is charged. Then, due to further rotation of the developing roller 510, the toner T on the developing roller 510, whose layer thickness has been restricted, is brought to the developing position opposing the photoconductor 20, and is used for developing the latent image formed on the photoconductor 20 under the alternating electric field at the developing position. The toner T on the developing roller 510 that has passed the developing position due to further rotation of the developing roller 510 passes the seal member 520 and is collected into the developing unit by the seal member 520 without being scraped off.

===Configuration of Elements===

Figure 6A:
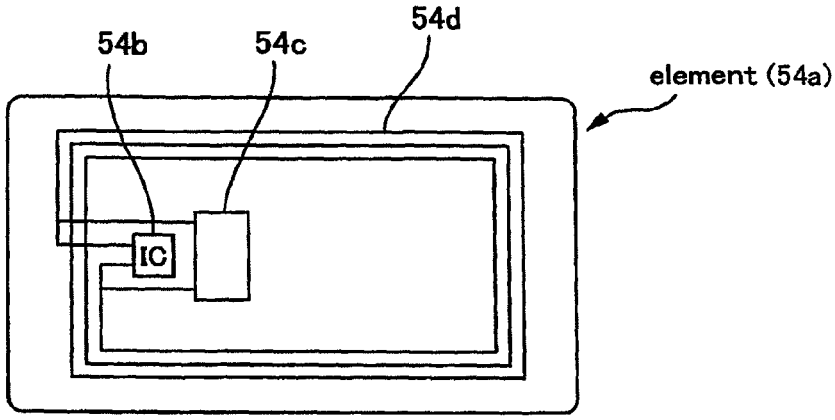
FIG. 6A is a plan perspective view showing the configuration of an element.
Figure 6B:
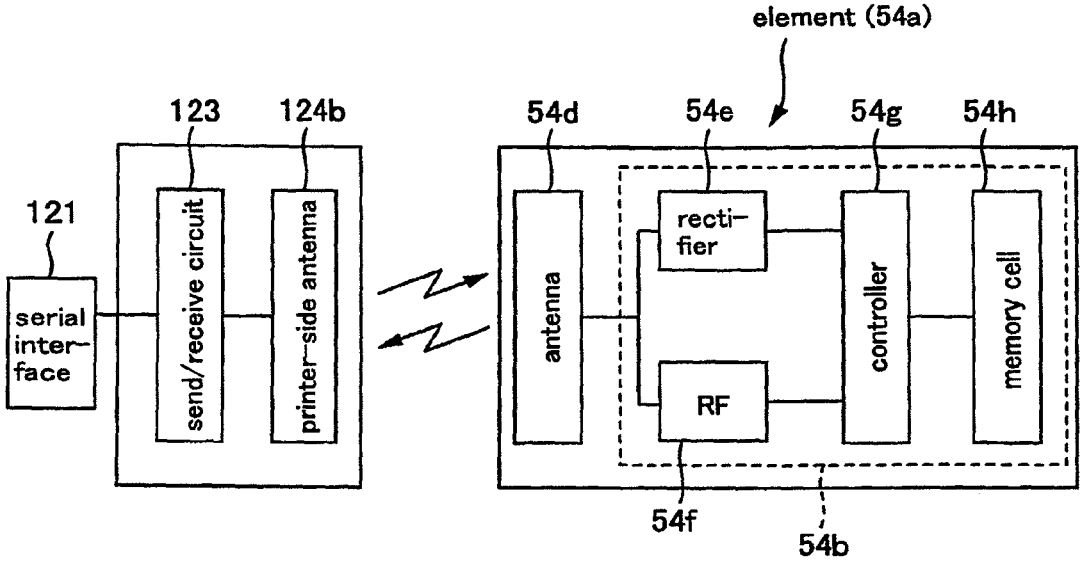
FIG. 6B is a block diagram for describing an internal configuration of the element and a send/receive section.

Next, the configuration of the elements of the developing units and the element of the photoconductor unit, including the configuration for sending and receiving data, is described with reference to FIG. 6A, FIG. 6B, FIG. 7, and FIG. 8. FIG. 6A is a plan perspective view showing the configuration of an element. FIG. 6B is a block diagram for describing the internal configuration of the element and the send/receive section. FIG. 7 is a diagram for describing the information stored in a memory cell 54*h* of the element 54*a*. FIG. 8 is a diagram for describing the information stored in the memory cell of the element 54*a* of the photoconductor unit 75.

Since the elements of the developing units other than the yellow developing unit 54 also have the same configuration, the element 54*a* of the yellow developing unit 54 is taken as an example and described below.

If the element 54*a* and the printer-side antenna 124*b* are in a predetermined positional relationship, for example, if they are within 10 mm of one another, information can be sent and received without the element and the antenna being in contact with one another. The element 54*a* is overall very compact and thin, and one of its sides can be made adhesive and can be made to adhere to an object as a sticker. It is known as a memory tag, for example, and is sold commercially in various forms.

The element 54*a* has a non-contact IC chip 54*b*, a resonant capacitor 54*c* that is formed by etching a metal film, and a flat coil serving as an antenna 54*d*. These are mounted onto a plastic film and covered by a transparent cover sheet.

The printer unit 10*a* has a coil that serves as the printer-side antenna 124*b*, the send/receive circuit 123, and the serial interface 121 that is connected to the controller (CPU) 120 of the printer unit 10*a*.

The non-contact IC chip 54*b* has a rectifier 54*e*, a signal analysis section RF (Radio Frequency) 54*f*, a controller 54*g*, and the memory cell 54*h*. The memory cell 54*h* is a nonvolatile memory that can be electrically read and written, such as an NAND flash ROM, and is capable of storing information that has been written and allows the stored information to be read from the outside.

The antenna 54*d* of the element 54*a* and the printer-side antenna 124*b* wirelessly communicate with one another to read information stored in the memory cell 54*h* and write information into the memory cell 54*h*. Further, the high frequency signals that are generated by the send/receive circuit 123 of the printer unit 10*a* are induced as a high frequency magnetic field via the printer-side antenna 124*b*. This high frequency magnetic field is absorbed via the antenna 54*d* of the element 54*a*, is rectified by the rectifier 54*e*, and becomes a DC power source for driving each of the circuits in the IC chip 54*b*.

The memory cell 54*h* of the element 54*a* stores various types of information, as shown in FIG. 7. The address 00H stores unique ID information for each element, such as the serial number of the element. The address 01H stores the date that the developing unit was manufactured. The address 02H stores information for specifying the destination of the developing unit. The address 03H stores information for specifying the manufacturing line on which the developing unit was manufactured. The address 04H stores information for specifying models with which the developing unit is compatible. The address 05H stores toner remaining amount information as information indicating the amount of toner that is contained in the developing unit. The address 06H and subsequent areas store appropriate information.

The ID information that is stored on the memory cell 54*h* of the element 54*a* can be written at the time that the storage element is manufactured in the factory. The main unit of the printer 10 can read this ID information to identify each of the elements 54*a*, 51*a*, 52*a*, and 53*a*.

It should be noted that the element 75*a* of the photoconductor unit 75 has the same configuration. The memory cell of the element of the photoconductor unit 75 stores various types of information, as shown in FIG. 8.

The address 00H stores unique ID information for each element, such as the serial number of the element. The address 01H stores the date that the photoconductor unit was manufactured. The address 02H stores information for specifying the destination of the photoconductor unit. The address 03H stores information for specifying the manufacturing line on which the photoconductor unit was manufactured. The address 04H stores information for specifying models with which the photoconductor unit is compatible. The address 05H stores information indicating the total number of printed sheets of the printer unit 10*a* when the photoconductor unit is attached to the printer unit 10*a*. The address 06H stores information indicating the total number of printed sheets of the printer unit 10*a* when the photoconductor unit has reached its service life and is detached from the printer unit 10*a*. The address 07H stores the number of sheets for which color printing has been performed using the photoconductor unit. The address 08H stores the number of sheets for which monochrome printing has been performed using the photoconductor unit. The area of address 09H also stores appropriate information.

===Relationship Between Element and Printer-side Antenna===

Figure 9A:
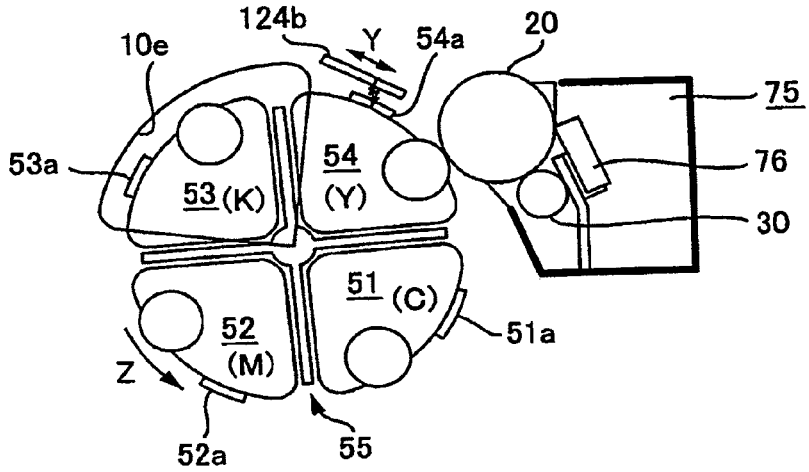
FIG. 9A is a diagram for describing the relationship between the element and the printer-side antenna when the yellow developing unit 54 is positioned at the developing position.
Figure 9B:
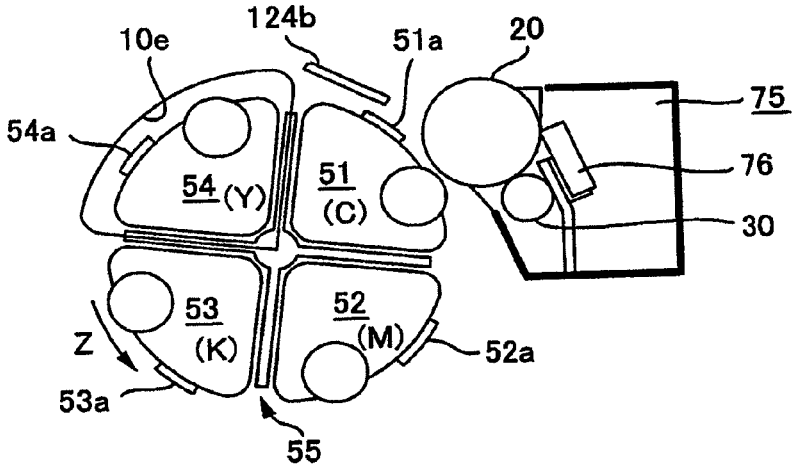
FIG. 9B is a diagram for describing the relationship between the element and the printer-side antenna when the yellow developing unit 54 is positioned at the attach/detach position.
Figure 9C:
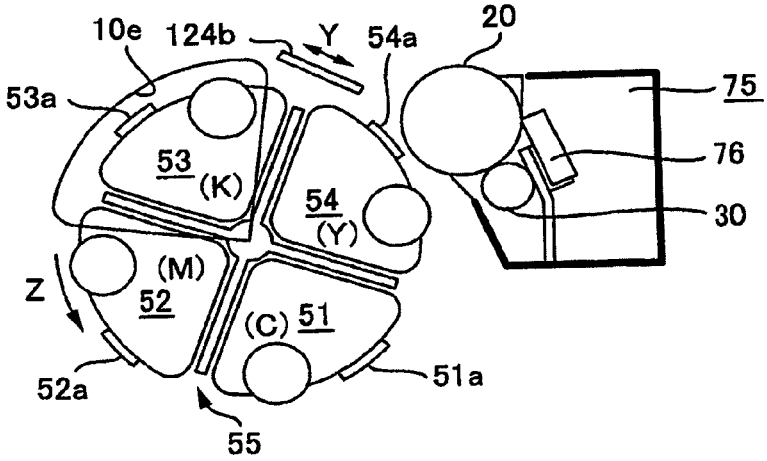
FIG. 9C is a diagram for describing the relationship between the element and the printer-side antenna when a rotary 55 is positioned at the home position.

Next, the relationship between the elements of the developing units and the printer-side antenna 124*b*, also with consideration to the relationship with the developing unit attach/detach opening 10*e*, is described with reference to FIG. 9A, FIG. 9B, and FIG. 9C. FIG. 9A is a diagram for describing the relationship between the element and the printer-side antenna when the yellow developing unit 54 is positioned at the developing position. FIG. 9B is a diagram for describing the relationship between the element and the printer-side antenna when the yellow developing unit 54 is positioned at the attach/detach position. FIG. 9C is a diagram for describing the relationship between the element and the printer-side antenna when the rotary 55 is positioned at the home position.

In FIG. 9A, the yellow developing unit 54 is positioned at the developing position (opposing position), and the element 54*a* of the yellow developing unit 54 is in opposition to the printer-side antenna 124*b* in a non-contact state. The printer-side antenna 124*b*, as shown in FIG. 9A, is provided so that the element 54*a* is positioned more to the inside than the printer-side antenna 124*b* in the radial direction of rotation of the rotary 55. It should be noted that the element 54*a* is positioned more to the outside than the body of the yellow developing unit in the radial direction of rotation of the rotary 55.

The printer-side antenna 124*b* is provided so that its longitudinal direction (in FIG. 9A to FIG. 9C, the Y direction) is in the direction of rotation of the rotary 55 (in FIG. 9A to FIG. 9C, the Z direction). By arranging the printer-side antenna 124*b* in this manner, wireless communication can be carried out effectively between the printer-side antenna 124*b* and the element 54*a*. That is, the printer-side antenna 124*b* can wirelessly communicate with the element 54*a* not only in the state shown in FIG. 9A but also in a state in which the rotary 55 has been rotated by a predetermined angle. By making the longitudinal direction of the printer-side antenna 124*b* follow the direction of rotation of the rotary 55, the range of angle of rotation of the rotary 55 in which wireless communication is possible can be made large.

It should be noted that the printer-side antenna 124*b* can wirelessly communicate with the element 54*a* not only when the rotary 55 is in a stopped state but also when the rotary 55 is in a moving state. That is, the printer-side antenna 124*b* can wirelessly communicate with the element 54*a* even if the element is moving.

FIG. 9B is a diagram showing a state in which the rotary 55 is positioned at the attach/detach position where the yellow developing unit 54 can be attached and detached via the developing unit attach/detach opening 10*e*. In the state shown in FIG. 9B, the yellow developing unit 54 can be attached to and detached from the attach/detach section 55*e* via the developing unit attach/detach opening 10*e*. Further, FIG. 9C shows a state in which the rotary 55 is positioned at the home position after the printer 10 has been turned ON and the initialization operation has been performed.

The same applies for the relationship between the printer-side antenna 124*a* and the element 75*a* of the photoconductor unit 75. The printer-side antenna 124*a* is in opposition to the element 75*a* of the photoconductor unit 75 in a non-contact state (see FIG. 2), and the printer-side antenna 124*a* can wirelessly communicate with the element 75*a* of the photoconductor unit 75 in a non-contact state.

===Rotation of Rotary 55 and Attach/Detach Position (Attaching and Detaching Position) of Developing Units===

Next, the relationship between the rotation of the rotary 55 and the position where the developing units are detached is described with reference again to FIG. 9A to FIG. 9C.

As described above, in the state shown in FIG. 9A, the yellow developing unit 54 is positioned at the developing position. When the rotary 55 is rotated from this state by a predetermined angle in the Z direction, the state shown in FIG. 9B is attained. In the state shown in FIG. 9B, the yellow developing unit 54 is positioned at a position where it can be attached and detached. In this state, the yellow developing unit 54 can be attached and detached via the attach/detach opening 10*e*, that is, it can be mounted to the attach/detach section 55*e* or it can be removed from the attach/detach section 55*e*. Then, when the rotary 55 is rotated from the state shown in FIG. 9B by a predetermined angle in the Z direction, the cyan developing unit 51, which is positioned upstream in the direction of rotation of the rotary 55, is positioned at the developing position.

It should be noted that FIG. 9C shows a state in which the rotary 55 is positioned at the home position after the printer 10 has been turned ON and the initialization operation has been performed.

===Writing Information into Elements of Developing Units===

Figure 10:
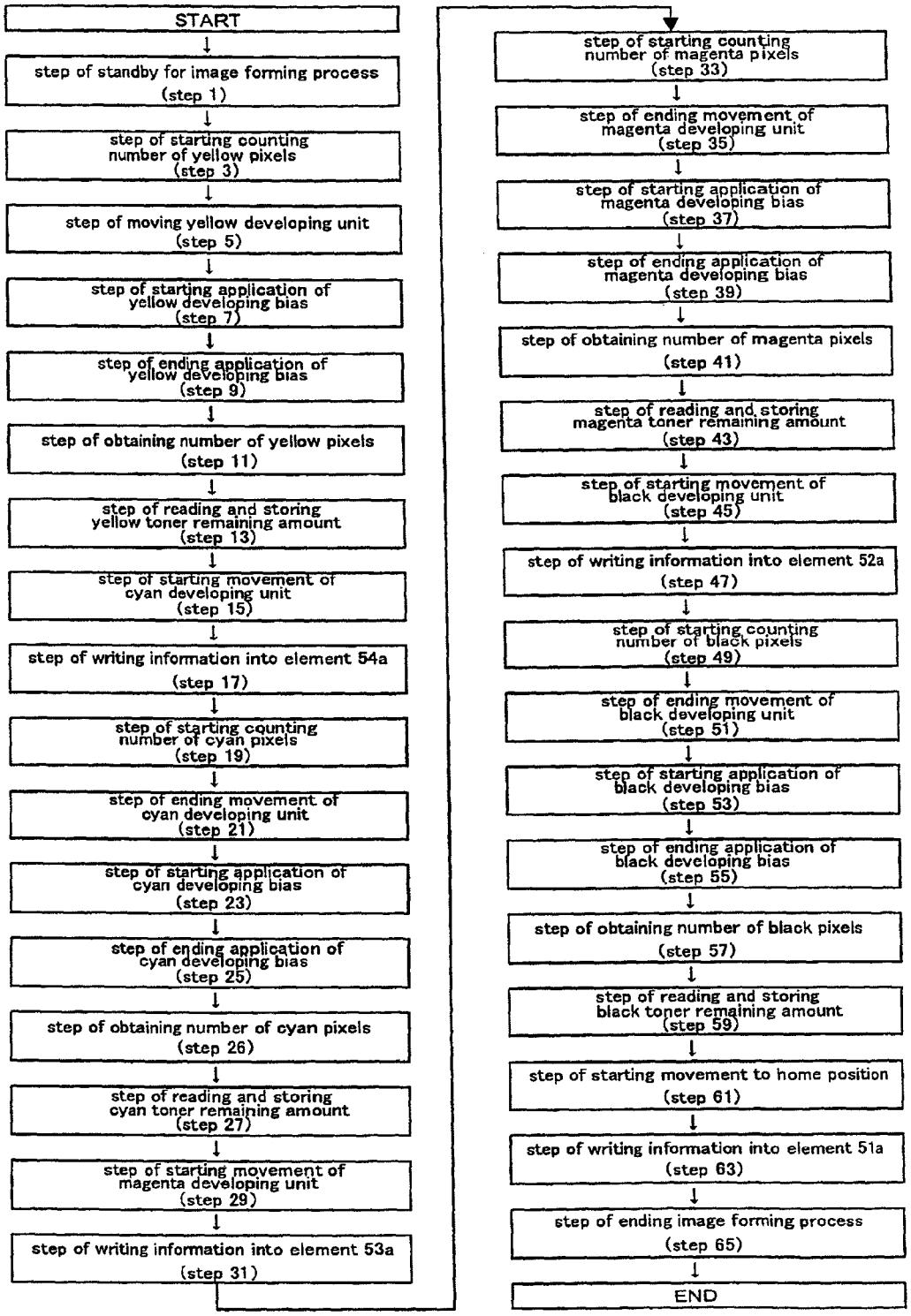
FIG. 10 is a flowchart for describing how information is written into the elements of the developing units.

Next, the writing of information into the elements of the developing units is described with reference to FIG. 10. FIG. 10 is a flowchart for describing how information is written into the elements of the developing units.

<Step of Standby for Image Forming Process (Step 1)>

When the printer 10 is turned ON, a predetermined initialization operation is performed, and the printer 10 enters an image forming process standby state. When an image signal, which is an image forming process command from the host computer, is input to the main controller 101 of the printer 10 via the interface (I/F) 112, the photoconductor 20 and the intermediate transferring body 70 are rotated. Then, the read sensor for synchronization RS detects the reference position of the intermediate transferring body 70 and outputs a pulse signal. The unit controller 102 executes the following control, taking the pulse signal that has been received as a reference.

<Step of Starting Counting Number of Yellow Pixels (Step 3)>

A latent image that corresponds to the yellow image information is formed on the charged photoconductor by the exposing unit 40. At this time, the pixel counter 127*a* starts counting the number of pixels that are input to the exposing unit 40.

<Step of Moving Yellow Developing Unit (Step 5)>

The rotary 55 is rotated, and the yellow developing unit 54 is moved to the developing position.

<Step of Starting Application of Yellow Developing Bias (Step 7)>

Application of a developing bias to the developing roller of the yellow developing unit 54 is started. Thus, the latent image formed on the photoconductor 20 is developed by yellow toner. The developing bias that is applied is a voltage obtained by superimposing an AC voltage and a DC voltage, as mentioned above. It should be noted that the developing bias may be applied to the developing roller before the yellow developing unit 54 arrives at the developing position, or the developing bias may be applied to the developing roller after the yellow developing unit 54 arrives at the developing position.

<Step of Ending Application of Yellow Developing Bias (Step 9)>

At a predetermined timing, application of the developing bias to the developing roller of the yellow developing unit 54 is ended. Thus, the operation of developing with the yellow developing unit 54 is ended.

<Step of Obtaining Number of Yellow Pixels (Step 11)>

The number of pixels that have been counted is obtained from the pixel counter 127*a*. The number of counted pixels is proportional to the amount of consumption of toner, and thus the amount of consumption of yellow toner YT can be found.

<Step of Reading and Storing Yellow Toner Remaining Amount (Step 13)>

The remaining amount of yellow toner YY that is stored in the RAM is read out from the RAM, and a value YYnew obtained by subtracting the consumption amount YT from the remaining amount YY is stored in the RAM as the new remaining amount.

<Step of Starting Movement of Cyan Developing Unit (Step 15)>

The rotary 55 starts rotating so as to position the cyan developing unit 51 at the developing position.

<Step of Writing Information into Element 54*a* (Step 17)>

The value YYnew obtained by subtracting the consumption amount YT from the remaining amount YY is written into the element 54*a* of the yellow developing unit 54. This writing is carried out using the printer-side antenna 124*b*, without it being in contact with the element 54*a* which is moving. It should be noted that when this writing is carried out, the yellow developing unit 54 has not reached the detaching position (the attach/detach position) where it can be detached via the attach/detach opening 10*e*.

<Step of Starting Counting Number of Cyan Pixels (Step 19)>

A latent image that corresponds to the cyan image information is formed on the charged photoconductor by the exposing unit 40. At this time, the pixel counter 127*a* starts counting the number of pixels that are input to the exposing unit 40.

<Step of Ending Movement of Cyan Developing Unit (Step 21)>

The rotation of the rotary 55 for positioning the cyan developing unit 51 at the developing position is ended. Thus, the cyan developing unit 51 arrives at the developing position.

<Step of Starting Application of Cyan Developing Bias (Step 23)>

Application of a developing bias to the developing roller of the cyan developing unit 51 is started. Thus, the latent image formed on the photoconductor 20 is developed by cyan toner.

<Step of Ending Application of Cyan Developing Bias (Step 25)>

At a predetermined timing, application of the developing bias to the developing roller of the cyan developing unit 51 is ended. Thus, the operation of developing with the cyan developing unit 51 is ended.

<Step of Obtaining Number of Cyan Pixels (Step 26)>

The number of pixels that have been counted is obtained from the pixel counter 127*a*. The number of counted pixels is proportional to the amount of consumption of toner, and thus the amount of consumption of cyan toner CT can be found.

<Step of Reading and Storing

Cyan Toner Remaining Amount (Step 27)>

The remaining amount of cyan toner CC that is stored in the RAM is read out from the RAM, and a value CCnew obtained by subtracting the consumption amount CT from the remaining amount CC is stored in the RAM as the new remaining amount.

<Step of Starting Movement of Magenta Developing Unit (Step 29)>

The rotary 55 starts rotating so as to position the magenta developing unit 52 at the developing position.

<Step of Writing Information into Element 51*a* (Step 31)>

The value CCnew obtained by subtracting the consumption amount CT from the remaining amount CC is written into the element 51*a* of the cyan developing unit 51. This writing is carried out using the printer-side antenna 124*b*, without it being in contact with the element 51*a* which is moving. It should be noted that when this writing is carried out, the cyan developing unit 51 has not reached the detaching position (the attach/detach position) where it can be detached via the attach/detach opening 10*e*.

<Step of Starting Counting Number of Magenta Pixels (Step 33)>

A latent image that corresponds to the magenta image information is formed on the charged photoconductor by the exposing unit 40. At this time, the pixel counter 127*a* starts counting the number of pixels that are input to the exposing unit 40.

<Step of Ending Movement of Magenta Developing Unit (Step 35)>

The rotation of the rotary 55 for positioning the magenta developing unit 52 at the developing position is ended. Thus, the magenta developing unit 52 arrives at the developing position.

<Step of Starting Application of Magenta Developing Bias (Step 37)>

Application of a developing bias to the developing roller of the magenta developing unit 52 is started. Thus, the latent image formed on the photoconductor 20 is developed by magenta toner.

<Step of Ending Application of Magenta Developing Bias (Step 39)>

At a predetermined timing, application of the developing bias to the developing roller of the magenta developing unit 52 is ended. Thus, the operation of developing with the magenta developing unit 52 is ended.

<Step of Obtaining Number of Magenta Pixels (Step 41)>

The number of pixels that have been counted is obtained from the pixel counter 127*a*. The number of counted pixels is proportional to the amount of consumption of toner, and thus the amount of consumption of magenta toner MT can be found.

<Step of Reading and Storing Magenta Toner Remaining Amount (Step 43)>

The remaining amount of magenta toner MM that is stored in the RAM is read out from the RAM, and a value MMnew obtained by subtracting the consumption amount MT from the remaining amount MM is stored in the RAM as the new remaining amount.

<Step of Starting Movement of Black Developing Unit (Step 45)>

The rotary 55 starts rotating so as to position the black developing unit 53 at the developing position.

<Step of Writing Information into Element 52*a* (Step 47)>

The value MMnew obtained by subtracting the consumption amount MT from the remaining amount MM is written into the element 52*a* of the magenta developing unit 52. This writing is carried out using the printer-side antenna 124*b*, without it being in contact with the element 52*a* which is moving. It should be noted that when this writing is carried out, the magenta developing unit 52 has not reached the detaching position (the attach/detach position) where it can be detached via the attach/detach opening 10*e*.

<Step of Starting Counting Number of Black Pixels (Step 49)>

A latent image that corresponds to the black image information is formed on the charged photoconductor by the exposing unit 40. At this time, the pixel counter 127*a* starts counting the number of pixels that are input to the exposing unit 40.

<Step of Ending Movement of Black Developing Unit (Step 51)>

The rotation of the rotary 55 for positioning the black developing unit 53 at the developing position is ended. Thus, the black developing unit 53 arrives at the developing position.

<Step of Starting Application of Black Developing Bias (Step 53)>

Application of a developing bias to the developing roller of the black developing unit 53 is started. Thus, the latent image formed on the photoconductor 20 is developed by black toner.

<Step of Ending Application of Black Developing Bias (Step 55)>

At a predetermined timing, application of the developing bias to the developing roller of the black developing unit 53 is ended. Thus, the operation of developing with the black developing unit 53 is ended.

<Step of Obtaining Number of Black Pixels (Step 57)>

The number of pixels that have been counted is obtained from the pixel counter 127*a*. The number of counted pixels is proportional to the amount of consumption of toner, and thus the amount of consumption of black toner BT can be found.

<Step of Reading and Storing Black Toner Remaining Amount (Step 59)>

The remaining amount of black toner BB that is stored in the RAM is read out from the RAM, and a value BBnew obtained by subtracting the consumption amount BT from the remaining amount BB is stored in the RAM as the new remaining amount.

<Step of Starting Movement to Home Position (Step 61)>

Rotation of the rotary 55 is started so as to position the rotary 55 at the home position.

<Step of Writing Information into Element 53*a* (Step 63)>

The value BBnew obtained by subtracting the consumption amount BT from the remaining amount BB is written into the element 53*a* of the black developing unit 53. This writing is carried out using the printer-side antenna 124*b*, without it being in contact with the element 53*a* which is moving. It should be noted that when this writing is carried out, the black developing unit 53 has not reached the detaching position (the attach/detach position) where it can be detached via the attach/detach opening 10*e*.

<Step of Ending Printing Operation (Step 65)>

When the rotary 55 arrives at the home position, the image forming process is ended, and the printer enters the image forming process standby state.

As described above, during the period from the start to the end of the image forming process, the printer-side antenna 124*b*, which serves as the writing member, writes information into the element of each of the developing units when the AC voltage supply section 126*a* is not supplying an AC voltage to the developing roller. Consequently, information can be written accurately without being affected by, for example, noise caused by supplying the AC voltage.

Further, in the example described above, information is written into the elements by the printer-side antenna 124*b* during the period from when the developing unit starts moving from the developing unit until it arrives at the attach/detach position due to the movement of the moving body 55. Therefore, information can be effectively written using the period of time from when the unit starts moving from the developing position until when the unit arrives at the attach/detach position.

It should be noted that the information written into the elements is not limited to the remaining amount of toner. For example, it may also be the usage amount of toner, and moreover, it may also be, for example, the developing time or the number of sheets developed.

<<Detailed Description of the Writing Timing>>

The flowchart shown in FIG. 10 is only one example. The process may be freely modified as long as it is possible for the printer-side antenna 124*b*, which serves as a writing member, to write information into the element of each of the developing units when the AC voltage supply section 126*a* is not supplying an AC voltage to the developing roller during the period from the start to the end of the image forming process. For example, the step of writing information into the element may be performed before the step of starting movement of the developing unit. Moreover, it is also possible to perform the step of writing information into the element during the step of reading and storing the toner remaining amount.

Further, considering the relationship with the developing unit attach/detach opening 10*e*, the following writing timing is preferable.

In general, there is a possibility that the developing unit, for example, the yellow developing unit 54, attached to the attach/detach section may carelessly be detached via the attach/detach opening 10*e*. In particular, since the amount of developer in the yellow developing unit 54 decreases when the yellow developing unit 54 is positioned at the developing position and development is carried out, if the yellow developing unit 54 is detached before information about the amount of developer that has decreased is written into the element 54*a*, then there is a possibility that the amount of developer contained in the yellow developing unit 54, for example, cannot be ascertained.

Consequently, it is preferable that information is written into the element 54*a* during the period from when the yellow developing unit 54 arrives at the developing position (see FIG. 9A) until when it arrives at the attach/detach position (see FIG. 9B) due to movement of the rotary 55, which serves as the moving body. Thus, for example, even if the yellow developing unit 54 is detached via the attach/detach opening 10*e*, information, such as the amount of developer contained in the yellow developing unit 54, will be written with accuracy without being affected by noise caused by supplying the AC voltage, for example.

It is even more preferable that the printer-side antenna 124*b* writes information into the element 54*a* of the yellow developing unit 54 during the period from when the developing roller 510 provided in the yellow developing unit 54 that has arrived at the developing position ends developing the latent image until when the yellow developing unit 54 arrives at the attach/detach position.

Further, in the example described above, after the yellow developing unit 54 started moving from the developing position, the yellow developing unit 54 first arrived at the attach/detach position to and from which it can be attached and detached, and then the cyan developing unit 51, which is upstream in the direction of rotation, arrived at the developing position with the further rotation of the rotary 55. However, it is also possible that, after the yellow developing unit 54 has started moving from the developing position, the cyan developing unit 51, which is upstream in the direction of rotation, first arrives at the developing position and then the yellow developing unit 54 arrives at the attach/detach position, where it can be attached and detached, with the further rotation of the rotary 55.

If, during the period from when the developing unit starts moving from the developing position until when it arrives at the attach/detach position, another developing unit adjacent to this developing unit on the upstream side therefrom in the direction of rotation of the rotary arrives at the developing position as described above, then it is preferable that the printer-side antenna 124*b* writes information into the element of this developing unit during the period until the other developing unit arrives at the developing position. Since the printer-side antenna 124*b* writes information into the element of this developing unit during the period until the other developing unit arrives at the developing position, information would already be written into the element, even if, for example, this developing unit is forcibly detached after the other developing unit arrives at the developing position.

The above-mentioned detailed description of the writing timing for the yellow developing unit 54 can be similarly adopted for the developing units of the other colors as well.

===Writing Information into Element of Photoconductor Unit===

Figure 11:
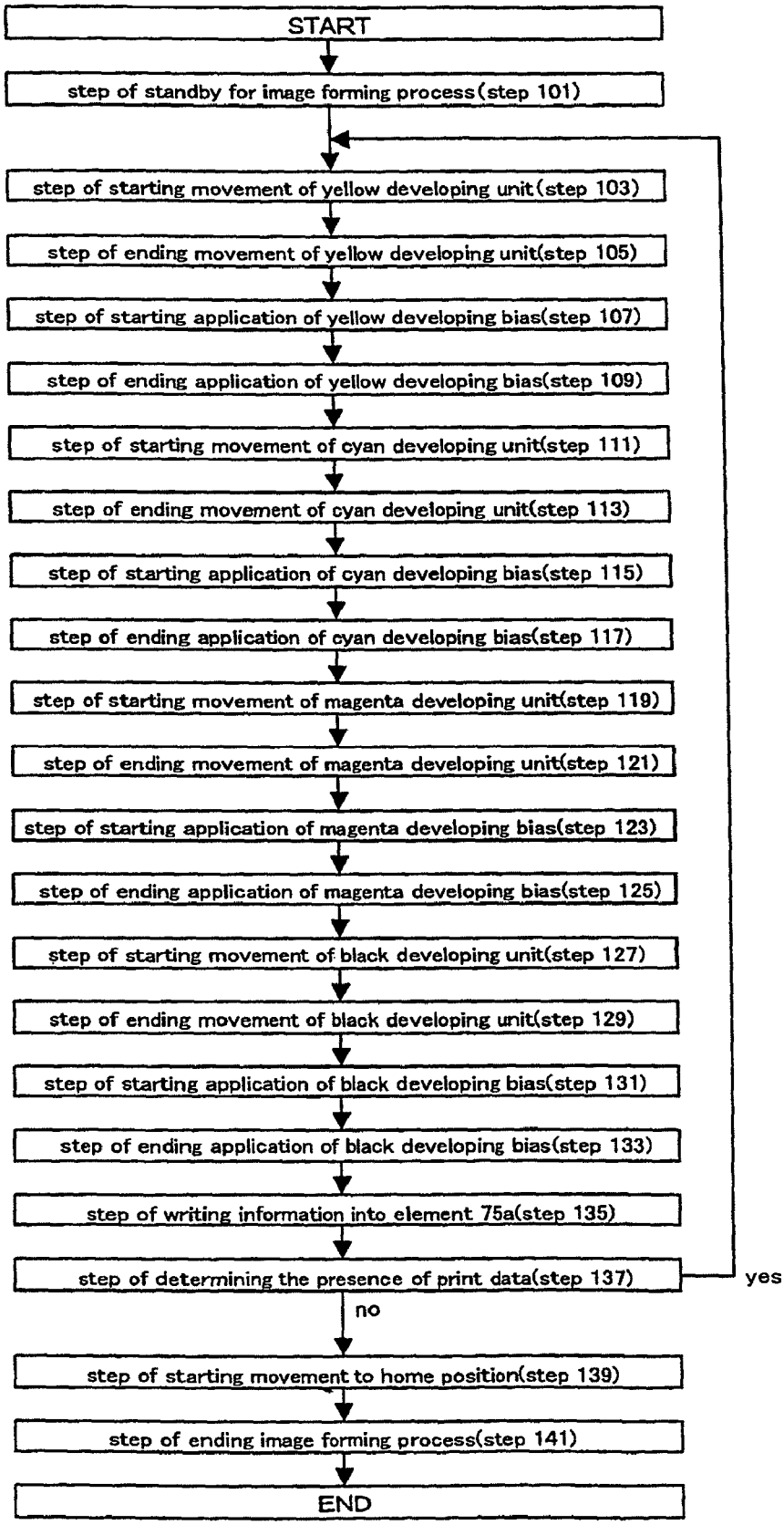
FIG. 11 is a flowchart showing an example of how information is written into the element 75*a* of the photoconductor unit 75.

Next, the writing of information into the element 75*a* of the photoconductor unit 75 is described with reference to FIG. 11. FIG. 11 is a flowchart showing an example in which information is written into the element 75*a* of the photoconductor unit 75.

<Step of Standby for Image Forming Process (Step 101)>

When the printer 10 is turned ON, a predetermined initialization operation is performed, and the printer 10 enters an image forming process standby state. When an image signal, which is an image forming process command from the host computer, is input to the main controller 101 of the printer 10 via the interface (I/F) 112, the photoconductor 20 and the intermediate transferring body 70 are rotated. Then, the read sensor for synchronization RS detects the reference position of the intermediate transferring body 70 and outputs a pulse signal. The unit controller 102 executes the following control, taking the pulse signal that has been received as a reference.

<Step of Starting Movement of Yellow Developing Unit (Step 103)>

The rotary 55 starts rotating so as to position the yellow developing unit 54 at the developing position.

<Step of Ending Movement of Yellow Developing Unit (Step 105)>

The rotation of the rotary 55 for positioning the yellow developing unit 54 at the developing position is ended. Thus, the yellow developing unit 54 arrives at the developing position.

<Step of Starting Application of Yellow Developing Bias (Step 107)>

Application of a developing bias to the developing roller of the yellow developing unit 54 is started. Thus, the latent image formed on the photoconductor 20 is developed by yellow toner. The developing bias that is applied is a voltage obtained by superimposing an AC voltage and a DC voltage, as mentioned above. It should be noted that the developing bias may be applied to the developing roller before the yellow developing unit 54 arrives at the developing position, or the developing bias may be applied to the developing roller after the yellow developing unit 54 arrives at the developing position.

<Step of Ending Application of Yellow Developing Bias (Step 109)>

At a predetermined timing, application of the developing bias to the developing roller of the yellow developing unit 54 is ended. Thus, the operation of developing with the yellow developing unit 54 is ended.

<Step of Starting Movement of Cyan Developing Unit (Step 111)>

The rotary 55 starts rotating so as to position the cyan developing unit 51 at the developing position.

<Step of Ending Movement of Cyan Developing Unit (Step 113)>

The rotation of the rotary 55 for positioning the cyan developing unit 51 at the developing position is ended. Thus, the cyan developing unit 51 arrives at the developing position.

<Step of Starting Application of Cyan Developing Bias (Step 115)>

Application of a developing bias to the developing roller of the cyan developing unit 51 is started. Thus, the latent image formed on the photoconductor 20 is developed by cyan toner.

<Step of Ending Application of Cyan Developing Bias (Step 117)>

At a predetermined timing, application of the developing bias to the developing roller of the cyan developing unit 51 is ended. Thus, the operation of developing with the cyan developing unit 51 is ended.

<Step of Starting Movement of Magenta Developing Unit (Step 119)>

The rotary 55 starts rotating so as to position the magenta developing unit 52 at the developing position.

<Step of Ending Movement of Magenta Developing Unit (Step 121)>

The rotation of the rotary 55 for positioning the magenta developing unit 52 at the developing position is ended. Thus, the magenta developing unit 52 arrives at the developing position.

<Step of Starting Application of Magenta Developing Bias (Step 123)>

Application of a developing bias to the developing roller of the magenta developing unit 52 is started. Thus, the latent image formed on the photoconductor 20 is developed by magenta toner.

<Step of Ending Application of Magenta Developing Bias (Step 125)>

At a predetermined timing, application of the developing bias to the developing roller of the magenta developing unit 52 is ended. Thus, the operation of developing with the magenta developing unit 52 is ended.

<Step of Starting Movement of Black Developing Unit (Step 127)>

The rotary 55 starts rotating so as to position the black developing unit 53 at the developing position.

<Step of Ending Movement of Black Developing Unit (Step 129)>

The rotation of the rotary 55 for positioning the black developing unit 53 at the developing position is ended. Thus, the black developing unit 53 arrives at the developing position.

<Step of Starting Application of Black Developing Bias (Step 131)>

Application of a developing bias to the developing roller of the black developing unit 53 is started. Thus, the latent image formed on the photoconductor 20 is developed by black toner.

<Step of Ending Application of Black Developing Bias (Step 133)>

At a predetermined timing, application of the developing bias to the developing roller of the black developing unit 53 is ended. Thus, the operation of developing with the black developing unit 53 is ended.

<Step of Writing Information into Element 75*a* (Step 135)>

Information indicating the number of sheets printed in color is written into the element 75*a* of the photoconductor unit 75 using the printer-side antenna 124*a*. The number of sheets printed in color may be the total number of sheets printed in color by the printer 10, or it may be the number of sheets for which color printing has been performed using the photoconductor unit 75 after the photoconductor unit 75 was attached to the printer unit 10*a*.

<Step of Determining the Presence of Print Data (Step 137)>

Whether or not there are further data to be printed is determined, and if there are print data, then the procedure proceeds to the <Step of Starting Movement of Yellow Developing Unit (Step 103)>.

<Step of Starting Movement to Home Position (Step 139)>

If there are print data, then rotation of the rotary 55 is started so as to position it at the home position.

<Step of Ending Printing Operation (Step 141)>

When the rotary 55 arrives at the home position, the image forming process is ended, and the printer enters the image forming process standby state.

As described above, during the period from the start to the end of the image forming process, the printer-side antenna 124*a*, which serves as the writing member, writes information into the element 75*a* of the photoconductor unit 75 when the AC voltage supply section 126*a* is not supplying an AC voltage to a developing roller. Consequently, information can be written accurately without being affected by, for example, noise caused by supplying the AC voltage.

It should be noted that the information written into the element 75*a* is not limited to the number of sheets printed in color. For example, as shown in FIG. 8, it can also be the number of sheets printed when usage starts, the number of sheets printed when usage ends, or the number of sheets printed in monochrome.

It may also be information about, for example, the remaining amount or the usage amount of toner of each of the developing units. In this case, for example, in place of the step of writing information into the element of each of the developing units in FIG. 10, it is possible to provide a step of writing information into the element 75*a* of the photoconductor unit 75.

Further, as regards the relationship between the developing unit 54 and the attach/detach opening 10*e*, it is preferable that the printer-side antenna 124*a* writes information into the element 75*a* of the photoconductor unit 75 during the period from when the developing unit arrives at the developing position until when it arrives at the detaching position due to movement of the rotary 55.

Further, if, during the period from when the developing unit starts moving from the developing position until when it arrives at the detaching position, another developing unit adjacent to this developing unit on the upstream side therefrom in the direction of movement of the rotary 55 arrives at the developing position, then it is preferable that the printer-side antenna 124*a* writes information into the element 75*a* of the photoconductor unit 75 during the period until the other developing unit arrives at the developing position.

===Other Embodiments of the First Embodiment===

In the foregoing, developing units according to the present invention were described according to a first embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

<Another Example of AC Voltage Application>

It is also possible to adopt a configuration in which the AC voltage supply section 126*a* supplies an AC voltage to the charging unit 30 via the charging unit drive circuit so that the charging unit 30 charges the photoconductor 20 in an alternating electric field. In this case, during the period from the start to the end of the image forming process, the printer-side antenna 124*b* can write information into the element of the developing unit attached to the attach/detach section when the AC voltage supply section 126*a* is not supplying an AC voltage to the charging unit 30. Thus, information can be written accurately without being affected by, for example, noise caused by supplying the AC voltage to the charging unit 30.

It is also possible to adopt a configuration in which the AC voltage supply section 126*a* supplies an AC voltage to the first transferring unit 60 via the first transferring unit drive circuit. In this case, during the period from the start to the end of the image forming process, the printer-side antenna 124*b* can write information into the element of the developing unit attached to the attach/detach section when the AC voltage supply section 126*a* is not supplying an AC voltage to the first transferring unit 60. Thus, information can be written accurately without being affected by, for example, noise caused by supplying the AC voltage to the first transferring unit 60.

<Intensity of the AC Voltage>

The present embodiment is particularly effective in image forming processing in which there is a large difference between the maximum voltage value and the minimum voltage value applied by the AC voltage supply section 126*a*. For example, it is particularly effective in image forming apparatuses in which the difference between the maximum voltage value and the minimum voltage value is 1000 volts or more. When the difference between the maximum voltage value and the minimum voltage value of the AC voltage is 1000 volts or more, the electromagnetic noise that occurs also becomes large. In such image forming apparatuses, by writing information with the writing member into the element of a developing unit that is attached to the attach/detach section when the AC voltage supply section 126*a* is not supplying an AC voltage during the period from the start to the end of the image forming process, it becomes possible to accurately write information without being affected by, for example, the large amount of noise that is caused by supplying the AC voltage.

<Developing Unit>

The developing unit is not limited to a device of the configuration described in the foregoing embodiment, and it is applicable to any type of developing unit. The developing unit may be of any configuration as long as it has an element into which information can be written and a developer containing section. For example, the developing unit does not have to include a developer bearing body, and the developing unit may be provided in the printer unit 10*a*.

For example, it is possible to use any material as the developer bearing roller, such as magnetic material, non-magnetic material, conductive material, insulating material, metal, rubber, and resin, as long as it is possible to structure a developer bearing roller. For example, as the material, it is possible to use: metal such as aluminum, nickel, stainless steel, and iron; rubber such as natural rubber, silicone rubber, urethane rubber, butadiene rubber, chloroprene rubber, neoprene rubber, and NBR; or resin such as styrene resin, vinyl chloride resin, polyurethane resin, polyethylene resin, methacrylate resin, and nylon resin. Further, it is without saying that these can be used even if the upper layer of these materials is coated. In this case, as the coating material, it is possible to use, for example, polyethylene, polystyrene, polyurethane, polyester, nylon, or acrylic resin. Further, it is possible to use any form, such as an in elastic body, an elastic body, a single-layer structure, a multi-layer structure, a film, and a roller. Further, the developer is not limited to toner, but it may be, for example, a two component developer in which a carrier is mixed.

Further, the same applies for the toner supplying member as well, and as the material therefor, other than polyurethane foam described above, it is possible to use, for example, polystyrene foam, polyethylene foam, polyester foam, ethylene propylene foam, nylon foam, or silicone foam. It should be noted that, as the foam cells of the toner supplying means, both open-cell foams and closed-cell foams can be used. It should be noted that there is no limitation to foam material, and it is possible to use rubber material having elasticity. More specifically, it is possible to use a material that is molded and in which a conductive agent such as carbon is dispersed into, for example, silicone rubber, urethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, or acrylic rubber.

<Photoconductor Unit>

The photoconductor unit 75 also is not limited to the device of the configuration described in the foregoing embodiment, and it is applicable to any type of device. It is only necessary that the photoconductor unit 75 has an element into which information can be written and a photoconductor. For example, it does not have to include the charging unit 30, and instead, the charging unit may be provided in the printer unit 10*a*. Further, the photoconductor is not limited to a roller-shaped photo conductive roller, and it may also be belt-shaped.

<Elements>

The elements of the developing units and the element of the photoconductor unit are not limited to the configuration described in the foregoing embodiment. It is only necessary that information can be written into them, and it is possible for them to be, for example, elements in which the antenna is provided separately.

<Image Forming Apparatus>

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

===Configuration of Computer System Etc.===

Next, an embodiment of a computer system, a computer program, and a storage medium on which the computer program is recorded, which serve as an example of an embodiment of the present invention, is described with reference to the drawings.

Figure 12:
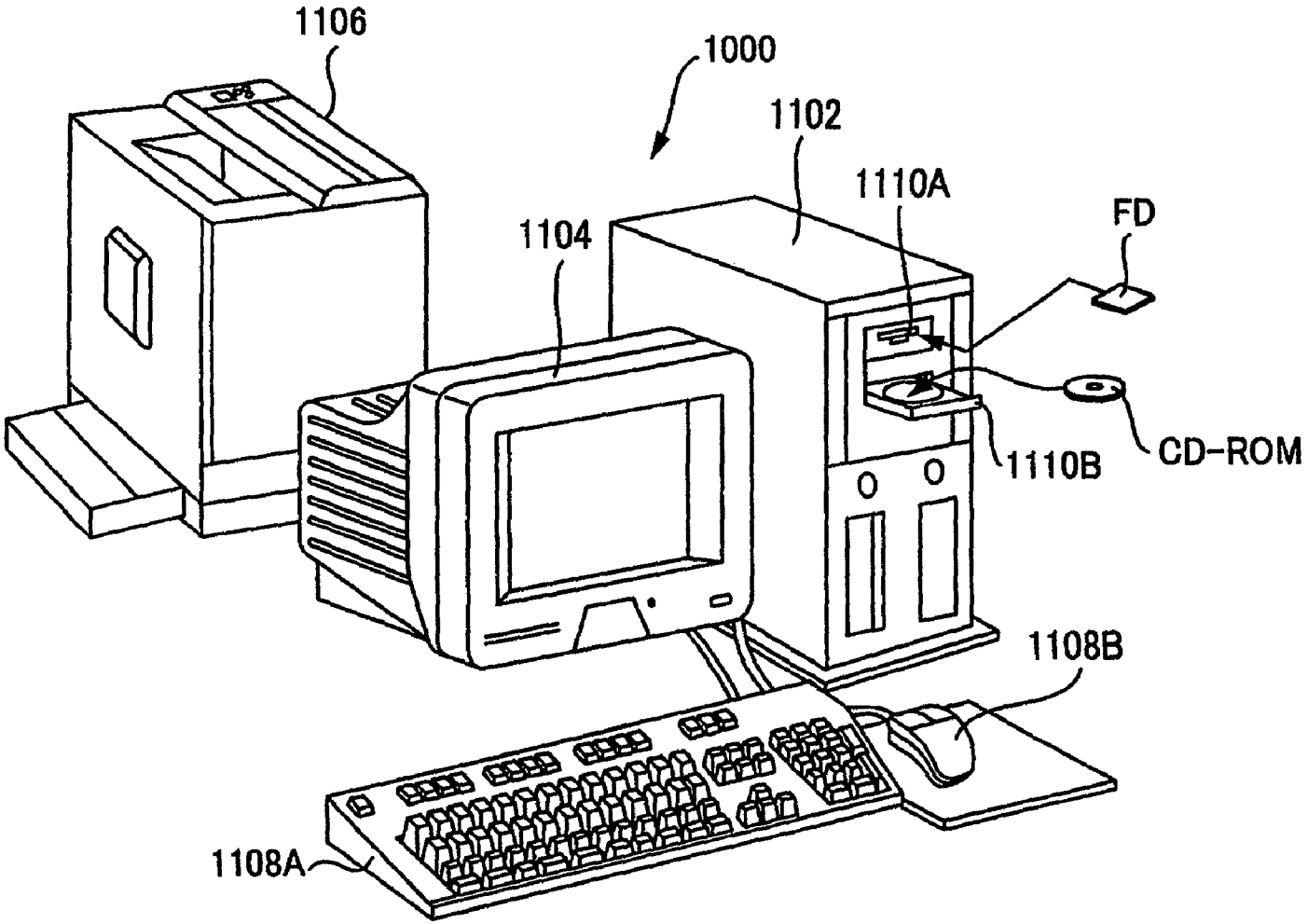
FIG. 12 is an explanatory diagram showing the external configuration of a computer system.

FIG. 12 is an explanatory drawing showing an external structure of a computer system. The computer system 1000 comprises a computer unit 1102, a display device 1104, a printer 1106, an input device 1108, and a reading device 1110. In this embodiment, the computer unit 1102 is accommodated in a mini-tower type housing, but this is not a limitation. A CRT (cathode ray tube), a plasma display, or a liquid crystal display device, for example, is generally used as the display device 1104, but this is not a limitation. The printer described above is used as the printer 1106. In this embodiment, a keyboard 1108A and a mouse 1108B are used as the input device 1108, but this is not a limitation. In this embodiment, a flexible disk drive device 1110A and a CD-ROM drive device 1110B are used as the reading device 1110, but the reading device is not limited to these, and it may also be other devices such as a MO (magneto optical) disk drive device and a DVD (digital versatile disk).

Figure 13:
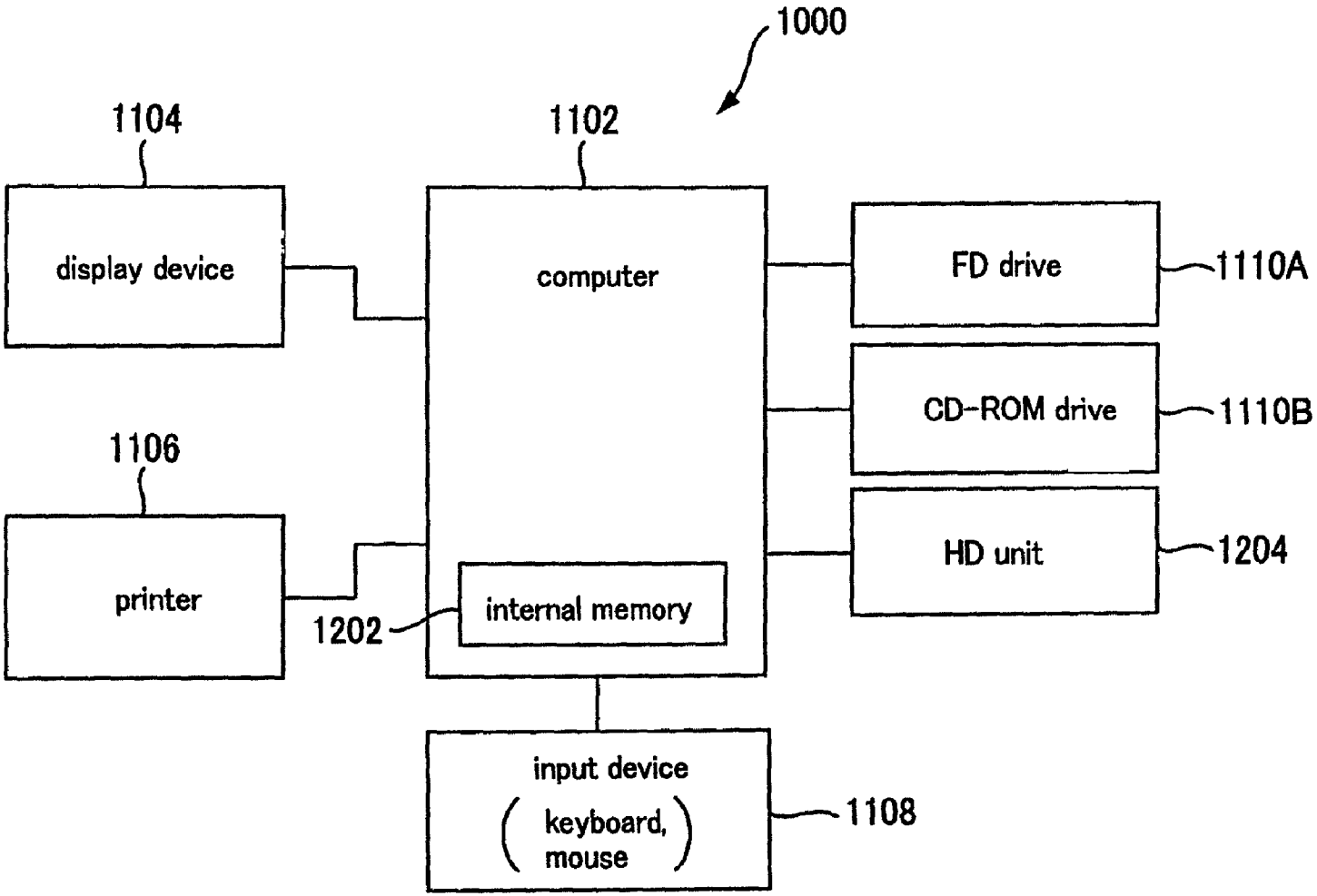
FIG. 13 is a block diagram showing the configuration of the computer system shown in FIG. 12.

FIG. 13 is a block diagram showing a configuration of the computer system shown in FIG. 12. Further provided are an internal memory 1202, such as a RAM inside the housing accommodating the computer unit 1102, and an external memory such as a hard disk drive unit 1204.

It should be noted that in the above description, an example in which the computer system is structured by connecting the printer 1106 to the computer unit 1102, the display device 1104, the input device 1108, and the reading device 1110 was described, but this is not a limitation. For example, the computer system can be made of the computer unit 1102 and the printer 1106, or the computer system does not have to comprise any one of the display device 1104, the input device 1108, and the reading device 1110.

Further, for example, the printer 1106 can have some of the functions or mechanisms of the computer unit 1102, the display device 1104, the input device 1108, and the reading device 1110. As an example, the printer 1106 may be configured so as to have an image processing section for carrying out image processing, a displaying section for carrying out various types of displays, and a recording media attach/detach section to and from which recording media storing image data captured by a digital camera or the like are inserted and taken out.

As an overall system, the computer system that is achieved in this way becomes superior to conventional systems.

Second Embodiment

In the second embodiment, the arrangement of the element (2051*a*, 2052*a*, 2053*a*, 2054*a*) of each of the developing units is different from the first embodiment. The second embodiment is described below centering on features that are different from those of the first embodiment, and structures and processes of sections for which no particular description is given are the same as those of the first embodiment. Further, structures and processes, for example, having the same reference characters as those in the first embodiment are the same as those in the first embodiment.

===Overview of Developing Units===

Figure 14:
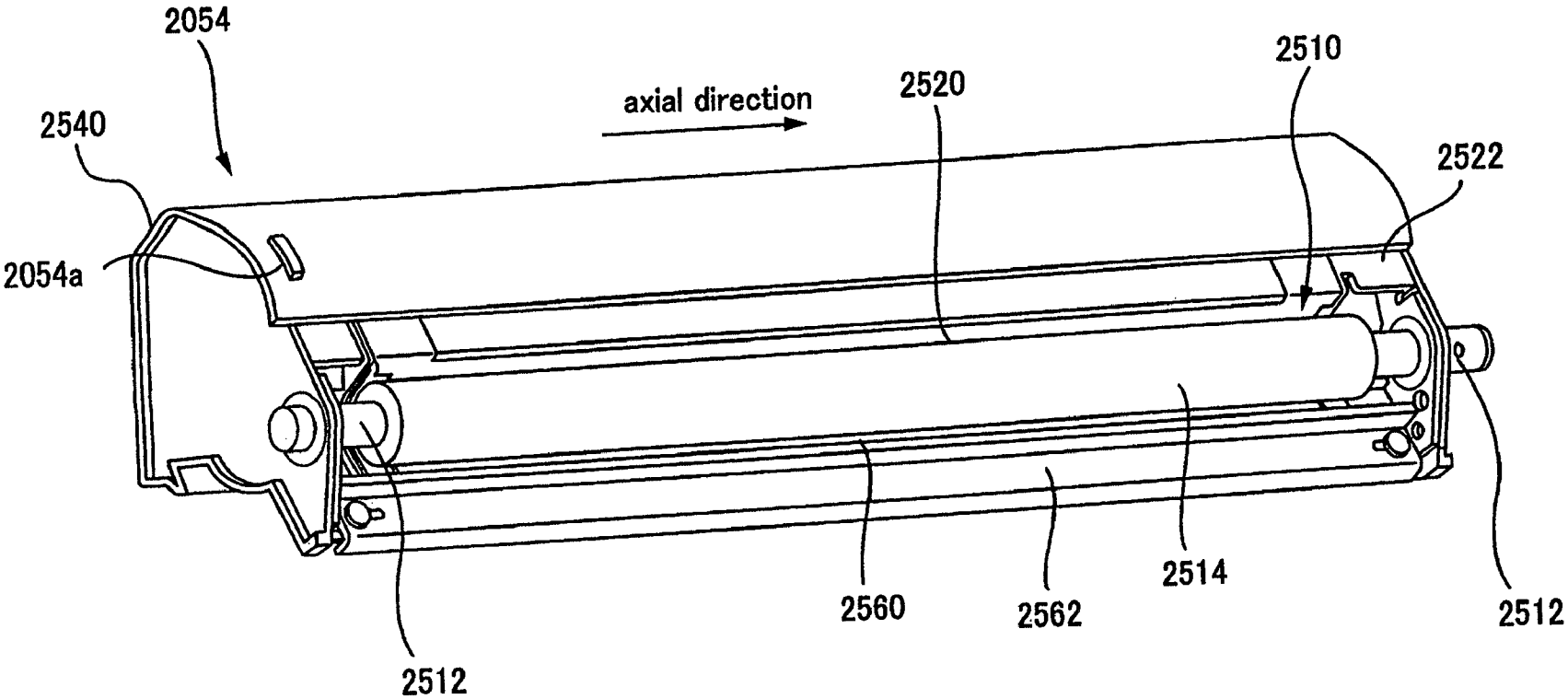
FIG. 14 is a perspective view of a yellow developing unit 2054 seen from the side of a developing roller 2510.
Figure 15:
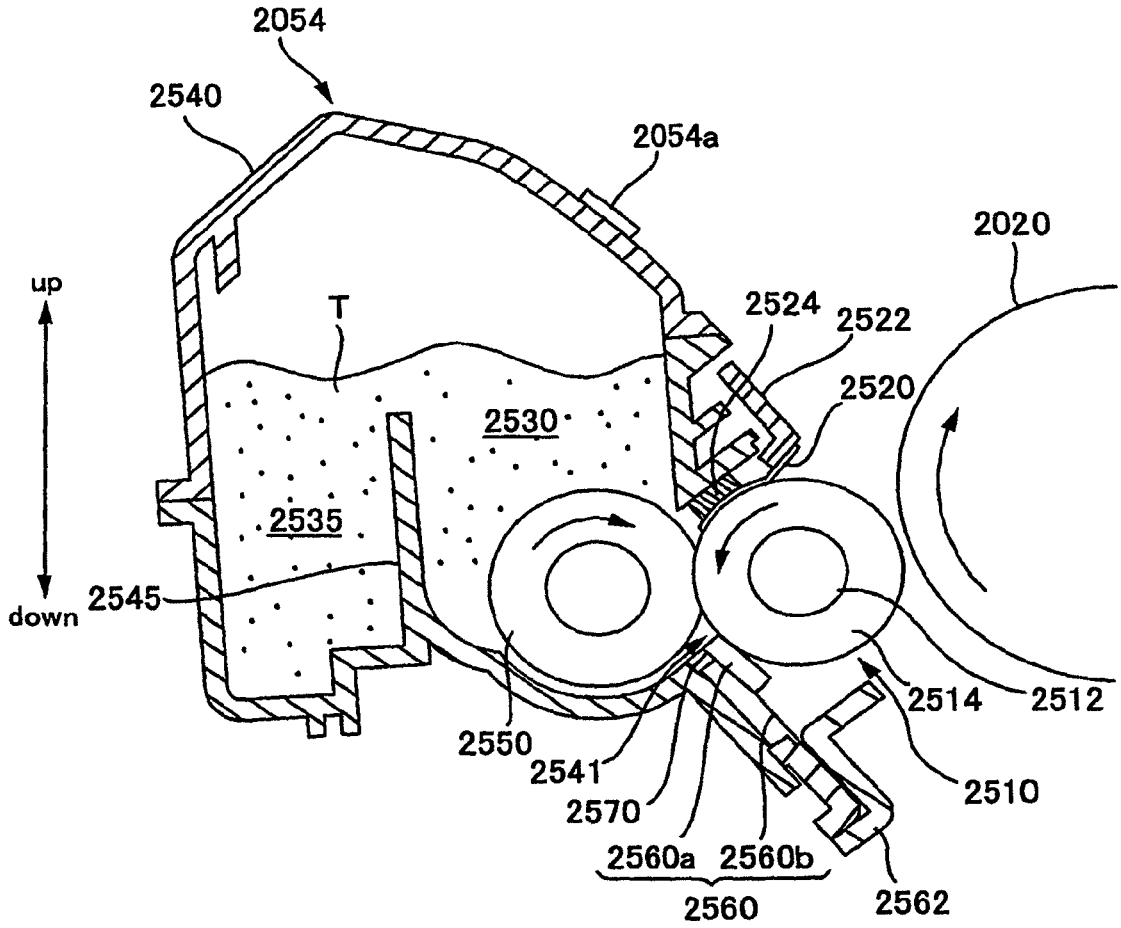
FIG. 15 is across-sectional view showing main structural components of the yellow developing unit 2054.

Next, an overview of the developing units is described using FIG. 14 and FIG. 15. FIG. 14 is a perspective view of the yellow developing unit 2054 seen from the side of a developing roller 2510. FIG. 15 is a cross-sectional view showing main structural components of the yellow developing unit 2054. It should be noted that in FIG. 15 as well, the up/down direction is shown by an arrow, and for example, the central axis of the developing roller 2510 is located lower than the central axis of the photoconductor 20. Further, in FIG. 15, the yellow developing unit 2054 is shown in a state in which it is positioned at a developing position that is in opposition to the photoconductor 20.

The YMCK developing device 50 is provided with the cyan developing unit 2051, which contains cyan (C) toner, the magenta developing unit 2052, which contains magenta (M) toner, the black developing unit 2053, which contains black (K) toner, and the yellow developing unit 2054, which contains yellow (Y) toner. Since the configuration of each of these developing units is the same, the yellow developing unit 2054 is described below.

The yellow developing unit 2054 is provided with, for example, a developer containing section, that is, a first containing section 2530 and a second containing section 2535 for containing yellow toner T which serves as the developer, an element 2054*a*, a housing 2540 for forming the developer containing section, the developing roller 2510 which serves as the developer bearing body, a toner supply roller 2550 for supplying toner T to the developing roller 2510, and a restriction blade 2560 for restricting the thickness of the layer of toner T that is bore on the developing roller 2510.

The housing 2540 is manufactured by joining, for example, an upper housing and a lower housing which have been integrally molded, and the inside of the housing is divided into the first containing section 2530 and the second containing section 2535 by a restriction wall 2545 that extends upward from the lower section (in the up/down direction of FIG. 15). The first containing section 2530 and the second containing section 2535 form developer containing sections (2530, 2535) for containing toner T which serves as a developer. The upper sections of the first containing section 2530 and the second containing section 2535 are in communication, and the movement of the toner T between them is restricted by the restriction wall 2545. It should be noted that it is also possible to provide a stirring member for stirring the toner T contained in the first containing section 2530 and the second containing section 2535. In the present embodiment, however, each of the developing units (the cyan developing unit 2051, the magenta developing unit 2052, the black developing unit 2053, and the yellow developing unit 2054) rotates in conjunction with the rotation of the rotary 55 so that the toner T in each developing unit is stirred. Therefore, a stirring member is not provided in the first containing section 2530 or the second containing section 2535.

The element 2054*a* is provided on the outer surface of the housing 2540. The element 2054*a* has a configuration that allows storage of information that has been written in.

An opening 2541 that communicates with the outside of the housing 2540 is provided in the lower section of the first containing section 2530. The toner supply roller 2550 is provided in the first containing section 2530 with its circumferential surface facing the opening 2541, and is rotatably supported on the housing 2540. Further, the developing roller 2510 is provided with its circumferential surface facing the opening 2541 from outside the housing 2540, and the developing roller 2510 abuts against the toner supply roller 2550.

The developing roller 2510 bears toner T and carries the toner to a developing position, which is in opposition to the photoconductor 20. The developing roller 2510 is made of, for example, aluminum, stainless steel, or iron, and if necessary, it can be subjected to nickel plating or chromium plating, and the toner bearing region can be subjected to sandblasting or the like. Further, the developing roller 2510 is provided such that its longitudinal direction is in the longitudinal direction of the yellow developing unit 2054.

Further, the developing roller 2510 has a rotating shaft 2512 and large diameter section 2514 whose diameter is greater than the diameter of the rotating shaft 2512 and which is for bearing the developer. The developing roller 2510 can rotate about the rotating shaft 2512, and as shown in FIG. 15, it rotates in the opposite direction (in FIG. 15, the counterclockwise direction) to the rotating direction of the photoconductor 20 (in FIG. 15, the clockwise direction). The rotating shaft 2512 is located lower than the central axis of the photoconductor 20. Further, as shown in FIG. 15, in a state in which the yellow developing unit 2054 is in opposition to the photoconductor 20, a gap exists between the developing roller 2510 and the photoconductor 20. That is, the yellow developing unit 2054 develops the latent image formed on the photoconductor 20 in a non-contacting state. It should be noted that the rotating shaft 2512 and the large diameter section 2514 are conductive, and when the latent image formed on the photoconductor 20 is developed, a voltage obtained by superimposing an AC voltage and a DC voltage, as mentioned above, is applied to the rotating shaft 2512 and the large diameter section 2514, and thus, an alternating electric field is formed between the developing roller 2510 and the photoconductor 20.

Further, the above-mentioned element 2054*a* is provided on the outer surface of the housing 2540 at a position more to the outside than the large diameter section 2514 in the axial direction of the rotating shaft 2512. As long as the element 2054*a* is positioned more to the outside than the large diameter section 2514 in the axial direction of the rotating shaft 2512, it can be provided either upstream or downstream in the axial direction of the developing roller 2510. In the present embodiment, however, if the direction shown in FIG. 14 is taken as the axial direction, then the element is provided upstream in this axial direction.

The toner supply roller 2550 supplies, to the developing roller 2510, the toner T contained in the first containing section 2530 and the second containing section 2535. The toner supply roller 2550 is made of polyurethane foam, for example, and abuts against the developing roller 2510 in a state in which it is elastically deformed. The toner supply roller 2550 is arranged at a lower section of the first containing section 2530, and the toner T contained in the first containing section 2530 and the second containing section is supplied to the developing roller 2510 by the toner supply roller 2550 at the lower section of the first containing section 2530. The toner supply roller 2550 can rotate about its central axis, and its central axis is located lower than the central rotating shaft of the developing roller 2510. Further, the toner supply roller 2550 rotates in the opposite direction (in FIG. 15, the clockwise direction) to the rotating direction of the developing roller 2510 (in FIG. 15, the counterclockwise direction). It should be noted that the toner supply roller 2550 has the function of supplying the toner T that is contained in the first containing section 2530 and the second containing section 2535 to the developing roller 2510 as well as the function of stripping off, from the developing roller 2510, the toner T that remains on the developing roller 2510 after development.

The restriction blade 2560 restricts the thickness of the toner T layer bore by the developing roller 2510, and gives charge to the toner T bore by the developing roller 2510. The restriction blade 2560 has a rubber section 2560*a* and a rubber support section 2560*b*. The rubber section 2560*a* is made of, for example, silicone rubber or urethane rubber, and the rubber support section 2560*b* is a thin plate made of, for example, phosphor bronze or stainless steel, and has a springy characteristic. The rubber section 2560*a* is supported by the rubber support section 2560*b*, and one end of the rubber support section 2560*b* is fixed to a blade support metal plate 2562. The blade support metal plate 2562 is fastened to a seal frame, and is attached to the housing 2540 together with the restriction blade 2560, forming a part of a seal unit 2520, which is described later. In this state, the rubber section 2560*a* is pressed against the developing roller 2510 by the elastic force created by the flexure of the rubber support section 2560*b*.

Further, a blade backing member 2570 made of Moltoprene or the like is provided on one side of the restriction blade 2560 opposite from the side of developing roller 2510. The blade backing member 2570 prevents the toner T from entering in between the rubber support section 2560*b* and the housing 2540 to stabilize the elastic force caused by the flexure of the rubber support section 2560*b*, and also presses the rubber section 2560*a* against the developing roller 2510 by applying force to the rubber section 2560*a* toward the developing roller 2510 from directly behind the rubber section 2560*a*. Consequently, the blade backing member 2570 improves the contact uniformity and the sealing properties of the rubber section 2560*a* with respect to the developing roller 2510.

The end of the restriction blade 2560 on the side opposite from the side supported by the blade support metal plate 2562, that is, its tip, is not in contact with the developing roller 2510; rather, a section at a predetermined distance from its tip contacts, with some breadth, the developing roller 2510. That is, the restriction blade 2560 does not abut against the developing roller 2510 at its edge but rather at its mid section. Further, the restriction blade 2560 is arranged such that its tip is facing upstream in the rotating direction of the developing roller 2510, and thus, makes a so-called counter-abutment with respect to the roller. It should be noted that the abutting position where the restriction blade 2560 abuts against the developing roller 2510 is located lower than the central axis of the developing roller 2510 and is also located lower than the central axis of the toner supply roller 2550.

The seal member 2520 prevents the toner T in the yellow developing unit 2054 from spilling out from the unit, and also collects the toner T on the developing roller 2510, which has passed the developing position, into the developing unit without scraping it off. The seal member 2520 is a seal made of polyethylene film or the like. The seal member 2520 is supported by a seal support metal plate 2522, and is attached to the frame 2540 via the seal support metal plate 2522. A seal urging member 2524 made of Moltoprene or the like is provided on one side of the seal member 2520 opposite from the side of the developing roller 2510, and due to the elastic force of the seal urging member 2524, the seal member 2520 is pressed against the developing roller 2510. It should be noted that the abutting position where the seal member 2520 abuts against the developing roller 2510 is located above the central axis of the developing roller 2510.

In the yellow developing unit 2054 configured in this manner, the toner supply roller 2550 supplies, to the developing roller 2510, the toner T that is contained in the first containing section 2530 and the second containing section 2535, which serve as developer containing sections. The toner T that is supplied to the developing roller 2510 is brought to the abutting position of the restriction blade 2560 in conjunction with the rotation of the developing roller 2510, and when it passes the abutting position, the thickness of the toner layer is restricted and the toner is charged. Then, due to further rotation of the developing roller 2510, the toner T on the developing roller 2510, whose layer thickness has been restricted, is brought to the developing position opposing the photoconductor 20, and is used for developing the latent image formed on the photoconductor 20 under the alternating electric field at the developing position. The toner T on the developing roller 2510 that has passed the developing position due to further rotation of the developing roller 2510 passes the seal member 2520 and is collected into the developing unit by the seal member 2520 without being scraped off.

In this way, since the element is provided more to the outside than the large diameter section 2514 in the axial direction of the rotating shaft 2512, it is possible to achieve accurate communication with that element.

That is, as discussed in the section on the problems to be solved by the present invention, it is necessary that communication between the elements and the printer unit 10*a* is carried out accurately. For example, when writing information about the remaining amount of toner into the element of a developing unit, if a communication error occurs and incorrect information is written, then the amount of toner remaining in the developing unit cannot be managed properly.

On the other hand, in a situation where an AC voltage supply section for supplying an AC voltage is provided, there is a possibility that electromagnetic noise will be generated in the periphery of the AC voltage supply section while it is supplying an AC voltage.

Accordingly, as discussed above, if the element is provided more to the outside than the large diameter section 2514 in the axial direction of the rotating shaft 2512, then the distance between the element and the developing roller 2510 becomes longer by the amount of difference in diameter between the rotating shaft 2512 and the large diameter section 2514, compared to a case where, for example, the element is provided more to the inside than the large diameter section 2514 in the axial direction of the rotating shaft 2512. Therefore, even if the electromagnetic noise is generated due to the application of an AC voltage to the developing roller 2510, it becomes possible to reduce the negative influence on communication due to that noise, and thus, it becomes possible to achieve accurate communication with respect to the element.

===Relationship Between Element and Printer-side Antenna===

Figure 16A:
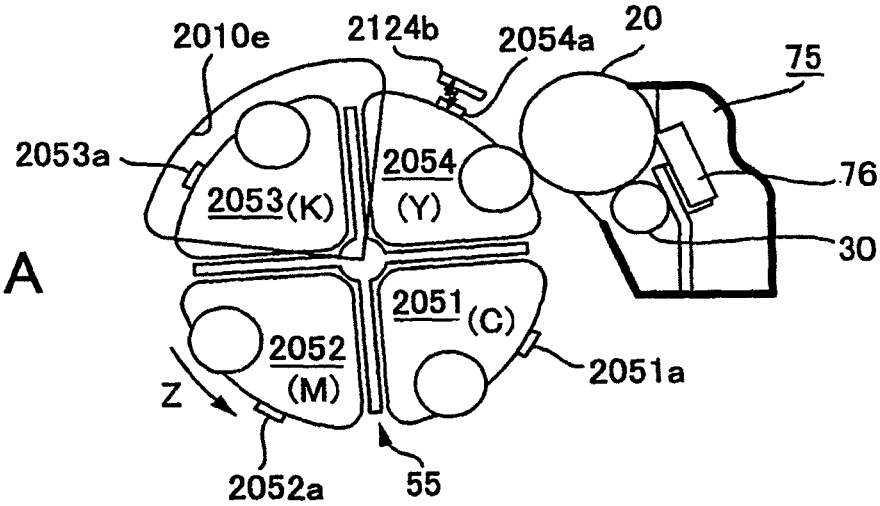
FIG. 16A is a diagram for describing the relationship between the element and the printer-side antenna when the yellow developing unit 2054 is positioned at the developing position.
Figure 16B:
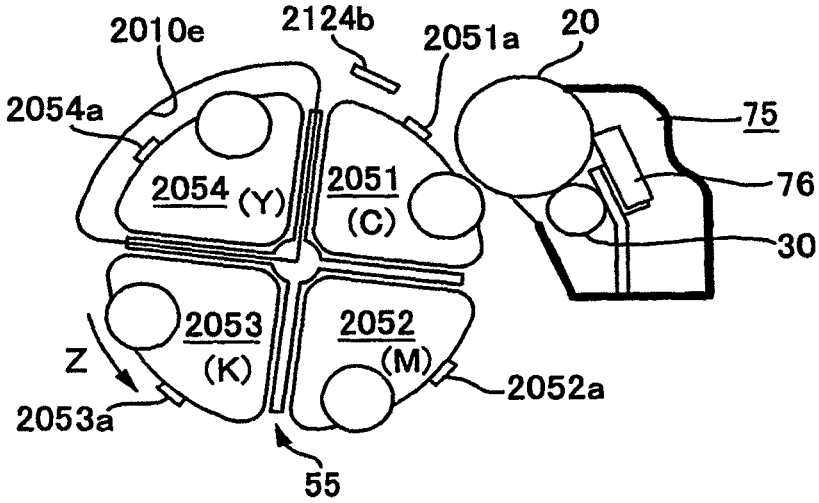
FIG. 16B is a diagram for describing the relationship between the element and the printer-side antenna when the yellow developing unit 2054 is positioned at the attach/detach position.
Figure 16C:
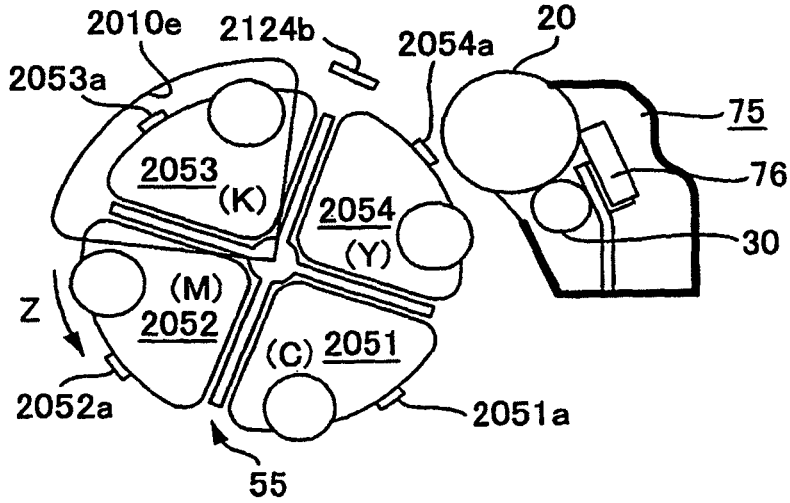
FIG. 16C is a diagram for describing the relationship between the element and the printer-side antenna when the rotary 55 is positioned at the home position.

Next, the relationship between the elements of the developing units and the printer-side antenna 2124*b* is described with reference to FIG. 16A to FIG. 16C. FIG. 16A is a diagram for describing the relationship between the element and the printer-side antenna when the yellow developing unit 2054 is positioned at the developing position. FIG. 16B is a diagram for describing the relationship between the element and the printer-side antenna when the yellow developing unit 2054 is positioned at the attach/detach position. FIG. 16C is a diagram for describing the relationship between the element and the printer-side antenna when the rotary 55 is positioned at the home position.

In FIG. 16A, the yellow developing unit 2054 is positioned at the developing position (opposing position), and the element 2054*a* of the yellow developing unit 2054 is in opposition to the printer-side antenna 2124*b* in a non-contact state. The printer-side antenna 2124*b*, as shown in FIG. 16A, is provided so that the element 2054*a* is positioned more to the inside than the printer-side antenna 2124*b* in the radial direction of rotation of the rotary 55.

It should be noted that the element 2054*a* is positioned more to the outside than the body of the yellow developing unit in the radial direction of rotation of the rotary 55.

Further, the printer-side antenna 2124*b* can wirelessly communicate with the element 2054*a* not only when the rotary 55 is in a stopped state but also when the rotary 55 is in a moving state. That is, the printer-side antenna 2124*b* can wirelessly communicate with the element 2054*a* even if the element is moving.

===Rotation of Rotary 55 and Attach/Detach Position (Attaching and Detaching Position) of Developing Units===

Next, the relationship between the rotation of the rotary 55 and the position where the developing units are detached is described with reference again to FIG. 16A to FIG. 16C.

As described above, in the state shown in FIG. 16A, the yellow developing unit 2054 is positioned at the developing position. When the rotary 55 is rotated from this state by a predetermined angle in the Z direction, the state shown in FIG. 16B is attained. In the state shown in FIG. 16B, the yellow developing unit 2054 is positioned at a position where it can be attached and detached. In this state, the yellow developing unit 2054 can be attached and detached via the attach/detach opening 10*e*, that is, it can be mounted to the attach/detach section 55*e* or it can be removed from the attach/detach section 55*e*. Then, when the rotary 55 is rotated from the state shown in FIG. 16B by a predetermined angle in the Z direction, the cyan developing unit 2051, which is positioned upstream in the direction of rotation of the rotary 55, is positioned at the developing position.

It should be noted that FIG. 16C shows a state in which the rotary 55 is positioned at the home position after the printer 10 has been turned ON and the initialization operation has been performed.

Further, the procedure for writing information into the element, for example, is the same as that in the first embodiment, and thus description thereof is omitted here.

===Other Embodiments of the Second Embodiment===

In the foregoing, developing units according to the present invention were described according to a second embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, the rotating shaft and the large diameter section had conductivity, and it was possible to apply an AC voltage to them. However, this is not a limitation.

In this case, however, the degree to which the electromagnetic noise affects communication is conspicuous. Therefore, the foregoing embodiment is more effective in terms that the above-described effects, that is, the effect that it becomes possible to reduce the negative influence that the electromagnetic noise has on communication and the effect that it becomes possible to achieve accurate communication with the element are more effectively achieved.

Further, in the foregoing embodiment, the developing unit had a housing for forming the developing roller, and the element was provided in the housing, but this is not a limitation. For example, it is possible to provide the element in another member other than the housing.

However, the configuration of the foregoing embodiment is preferable because it is possible to achieve a developing unit in which the element is provided at an easily attachable position.

Further, in the foregoing embodiment, the element was positioned more to the outside than the developing unit body, which includes the developer containing sections, in the radial direction of rotation of the rotary when the developing unit has been attached to the attach/detach section. However, this is not a limitation.

However, the configuration of the foregoing embodiment is more preferable in terms that, in such a case, it becomes even easier to attach the element because the element is arranged more to the outside than the developing unit body in the radial direction of rotation of the rotary.

Further, in the foregoing embodiment, the element was positioned more to the inside than the printer-side antenna (antenna for communicating with the developing unit element) in the radial direction of rotation of the rotary when the developing unit has been attached to the attach/detach section. However, this is not a limitation.

However, the configuration of the foregoing embodiment is more preferable in terms that, in such a case, it also becomes easy to attach the printer-side antenna (antenna for communicating with the developing unit element) because the element is arranged more to the inside than the printer-side antenna (antenna for communicating with the developing unit element) in the radial direction of rotation of the rotary.

Further, in the foregoing embodiment, the printer wrote information into the element of the developing unit attached to the attach/detach section using the printer-side antenna during the period from when the developing unit has arrived at the opposing position, where it is in opposition to the photoconductor, until when the developing unit has arrived at the detaching position, where it can be detached from the attach/detach section via the attach/detach opening, due to rotation of the rotary. However, this is not a limitation.

For example, it is also possible to write information, at another timing, into the element of the developing unit that is attached to the attach/detach section using the printer-side antenna.

If, however, the image forming apparatus is provided with an attach/detach opening through which the developing unit is attached to and detached from the attach/detach section, then there is a possibility that a developing unit attached to the attach/detach section may carelessly be detached via the attach/detach opening. In particular, since the amount of developer in the developing unit decreases when the developing unit is positioned at the opposing position and development is carried out, if the developing unit is detached before information about the amount of developer that has decreased is written into its element, then it may not be possible to ascertain the amount of developer contained in the developing unit, for example. For this reason, the configuration of the foregoing embodiment is more preferable in terms that it can solve this problem.

Further, in the foregoing embodiment, the printer comprised an AC voltage supply section for supplying an AC voltage, and the printer wrote information into the element of the developing unit attached to the attach/detach section using the antenna when the AC voltage supply section is not supplying an AC voltage to the developing roller. However, it is also possible for the printer to write information into the element of the developing unit attached to the attach/detach section using the antenna when the AC voltage supply section is supplying an AC voltage to the developing roller.

In such a case, there is an increased possibility that the electromagnetic noise will negatively affect communication because information is written into the element when the AC voltage supply section is supplying an AC voltage to the developing roller. Therefore, the above-described effects, that is, the effect that it becomes possible to reduce the negative influence that the electromagnetic noise has on communication and the effect that it becomes possible to achieve accurate communication with the element are more effectively achieved.

It is also possible for the difference between the maximum voltage value and the minimum voltage value of the AC voltage to be 1000 volts or more.

When the difference between the maximum voltage value and the minimum voltage value of the AC voltage is 1000 volts or more, the electromagnetic noise that is generated also becomes large, and therefore, the above-described effects, that is, the effect that it becomes possible to reduce the negative influence that the electromagnetic noise has on communication and the effect that it becomes possible to achieve accurate communication with the element are more effectively achieved.

Further, in the foregoing embodiment, the printer-side antenna (antenna for communicating with the developing unit element) was capable of communicating with the element in a non-contact state with respect to the element. However, this is not a limitation.

However, the configuration of the foregoing embodiment is more effective in terms that, in such a case, since the environment pertaining to the communication between the element and the printer-side antenna (antenna for communicating with the developing unit element) is severe compared to a case where, for example, communication is carried out in a state in which they are in contact with each other, the above-described effects, that is, the effect that it becomes possible to reduce the negative influence that the electromagnetic noise has on communication and the effect that it becomes possible to achieve accurate communication with the element are more effectively achieved.

<Photoconductor Unit>

The photoconductor unit 75 is not limited to the device of the configuration described in the foregoing embodiment, and it is applicable to any type of device. It is only necessary that the photoconductor unit 75 has an element into which information can be written and a photoconductor. For example, it does not have to include the charging unit 30, and instead, the charging unit may be provided in the printer unit 10*a*. Further, the photoconductor is not limited to a roller-shaped photo conductive roller, and it may also be belt-shaped.

<Developing Roller Etc.>

It is possible to use any material as the developer roller, such as magnetic material, non-magnetic material, conductive material, insulating material, metal, rubber, and resin, as long as it is possible to structure a developer roller. For example, as the material, it is possible to use: metal such as aluminum, nickel, stainless steel, and iron; rubber such as natural rubber, silicone rubber, urethane rubber, butadiene rubber, chloroprene rubber, neoprene rubber, and NBR; or resin such as styrene resin, vinyl chloride resin, polyurethane resin, polyethylene resin, methacrylate resin, and nylon resin. Further, it is without saying that these can be used even if the upper layer of these materials is coated. In this case, as the coating material, it is possible to use, for example, polyethylene, polystyrene, polyurethane, polyester, nylon, or acrylic resin. Further, it is possible to use any form, such as an in elastic body, an elastic body, a single-layer structure, a multi-layer structure, a film, and a roller. Further, the developer is not limited to toner, but it may be, for example, a two component developer in which a carrier is mixed. It should be noted that as regards the conductivity and insulation properties of the developing roller, it is preferable that the developing roller is conductive, as mentioned above.

Further, the same applies for the toner supplying member as well, and as the material therefor, other than polyurethane foam described above, it is possible to use, for example, polystyrene foam, polyethylene foam, polyester foam, ethylene propylene foam, nylon foam, or silicone foam. It should be noted that, as the foam cells of the toner supplying means, both open-cell foams and closed-cell foams can be used. It should be noted that there is no limitation to foam material, and it is possible to use rubber material having elasticity. More specifically, it is possible to use a material that is molded and in which a conductive agent such as carbon is dispersed into, for example, silicone rubber, urethane rubber, natural rubber, isoprene rubber, styrene butadiene rubber, butadiene rubber, chloroprene rubber, butyl rubber, ethylene propylene rubber, epichlorohydrin rubber, nitrile butadiene rubber, or acrylic rubber.

<Elements>

The elements of the developing units and the element of the photoconductor unit are not limited to the configuration described in the foregoing embodiment. It is only necessary that information can be written into them, and it is possible for them to be, for example, elements in which the antenna is provided separately.

<Image Forming Apparatus>

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

INDUSTRIAL APPLICABILITY

According to a main aspect of the present invention, it is possible to achieve an image forming apparatus and a computer system with which information can be accurately written into developing units having elements, for example.

Further, according to another main aspect of the present invention, it is possible to achieve a developing unit, an image forming apparatus, and a computer system with which communication with an element can be carried out accurately.

The invention claimed is:

1. An image forming apparatus comprising:

a developing unit comprising:

a developer bearing body including a rotating shaft and a large diameter section that has a diameter larger than a diameter of said rotating shaft and that is for bearing developer, wherein said developer bearing body is capable of rotating about said rotating shaft, an element with which communication is possible, and a developer containing section for containing a developer;

an attach/detach section to and from which said developing unit can be attached and detached; and an antenna for wirelessly communicating with the element of the developing unit attached to said attach/detach section, wherein said element of the developing unit is provided more to the outside in an axial direction of said rotating shaft than an end of said large diameter section in the axial direction of said rotating shaft, and wherein said image forming apparatus further comprises:

an attach/detach opening through which said developing unit is attached to and detached from said attach/detach section, and a photoconductor on which a latent image can be formed;

wherein in a state in which said developing unit is positioned at an opposing position where said developing unit is in opposition to said photoconductor due to rotation of said rotating body, said latent image can be developed with the developer contained in said developing unit;

wherein in a state in which said developing unit is positioned at a detaching position that is different from said opposing position due to rotation of said rotating body, said developing unit can be detached from said attach/detach section via said attach/detach opening; and wherein during a period from when said developing unit arrives at said opposing position until when said developing unit arrives at said detaching position due to rotation of said rotating body, said image forming apparatus writes information into said element of said developing unit using said antenna.

2. An image forming apparatus according to claim 1, wherein said rotating shaft and said large diameter section have conductivity, and an AC voltage is applied to them.

3. An image forming apparatus according to claim 1, wherein said developing unit has a housing for forming said developer containing section, and said element is provided on said housing.

4. An image forming apparatus according to claim 1, wherein said element is positioned more to the outside than a developing unit body, which includes said developer bearing body and said developer containing section, in a radial direction of rotation of said rotating body when said developing unit is attached to said attach/detach section.

5. An image forming apparatus according to claim 1, wherein said element is positioned more to the inside than said antenna in a radial direction of rotation of said rotating body when said developing unit is attached to said attach/detach section.

6. An image forming apparatus according to claim 1, wherein:

said image forming apparatus comprises an AC voltage supply section for supplying an AC voltage; and said image forming apparatus writes information into said element of the developing unit attached to said attach/detach section using said antenna when said AC voltage supply section is supplying an AC voltage to said developer bearing body.

7. An image forming apparatus according to claim 6, wherein a difference between a maximum voltage value and a minimum voltage value of said AC voltage is 1000 volts or more.

8. An image forming apparatus according to claim 1, wherein said antenna is capable of communicating with said element in a non-contact state with respect to said element.

9. A computer system comprising:

a computer unit;

a display device that is capable of being connected to said computer unit; and an image forming apparatus that is capable of being connected to said computer unit, said image forming apparatus comprising:

a developing unit comprising:

a developer bearing body including a rotating shaft and a large diameter section that has a diameter larger than a diameter of said rotating shaft and that is for bearing developer, wherein said developer bearing body is capable of rotating about said rotating shaft, an element with which communication is possible, and a developer containing section for containing developer;

an attach/detach section to and from which said developing unit can be attached and detached; and an antenna for wirelessly communicating with the element of the developing unit attached to said attach/detach section, wherein said element is provided more to the outside in an axial direction of said rotating shaft than an end of said large diameter section in the axial direction of said rotating shaft, wherein said image forming apparatus comprises:

an attach/detach opening through which said developing unit is attached to and detached from said attach/detach section, and a photoconductor on which a latent image can be formed;

wherein in a state in which said developing unit is positioned at an opposing position where said developing unit is in opposition to said photoconductor due to rotation of said rotating body, said latent image can be developed with the developer contained in said developing unit;

wherein in a state in which said developing unit is positioned at a detaching position that is different from said opposing position due to rotation of said rotating body, said developing unit can be detached from said attach/detach section via said attach/detach opening; and wherein during a period from when said developing unit arrives at said opposing position until when said developing unit arrives at said detaching position due to rotation of said rotating body, said image forming apparatus writes information into said element of said developing unit using said antenna.

* * * * *